US010692458B2

(12) United States Patent
Pyun et al.

(10) Patent No.: US 10,692,458 B2
(45) Date of Patent: Jun. 23, 2020

(54) DISPLAY DEVICE WHICH COMPENSATES FOR DISTORTED SIGNAL USING MEASURED INFORMATION

(71) Applicant: Samsung Display Co., Ltd., Yongin-Si, Gyeonggi-Do (KR)

(72) Inventors: Kihyun Pyun, Gwangmyeong-si (KR); Minyoung Park, Busan (KR); Sung-jun Kim, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 39 days.

(21) Appl. No.: 16/047,174

(22) Filed: Jul. 27, 2018

(65) Prior Publication Data

US 2019/0035351 A1 Jan. 31, 2019

(30) Foreign Application Priority Data

Jul. 31, 2017 (KR) ..... 10-2017-0097276

(51) Int. Cl.
*G09G 3/36* (2006.01)

(52) U.S. Cl.
CPC ... *G09G 3/3688* (2013.01); *G09G 2310/0291* (2013.01); *G09G 2310/0294* (2013.01); *G09G 2310/06* (2013.01); *G09G 2310/08* (2013.01); *G09G 2320/0693* (2013.01); *G09G 2370/08* (2013.01)

(58) Field of Classification Search
CPC ..... G09G 2310/0291
See application file for complete search history.

(56) References Cited

U.S. PATENT DOCUMENTS 6,239,729 B1 * 5/2001 Takeuchi ..... G09G 5/008 341/100
2017/0085618 A1 3/2017 Titus
2017/0104867 A1 4/2017 Kim et al.
2017/0105044 A1 4/2017 Ravindran et al.
2017/0124957 A1 5/2017 Ahn et al.

FOREIGN PATENT DOCUMENTS

KR 1020170051647 A 5/2017

* cited by examiner

*Primary Examiner* — Gustavo Polo
(74) *Attorney, Agent, or Firm* — Cantor Colburn LLP

(57) ABSTRACT

A display device includes a signal controller and a data driving circuit. The data driving circuit includes a plurality of driving chips. At least one of the driving chips monitors a degree of distortion of a data signal. The at least one of the driving chips generates a feedback signal based on the monitored result to compensate for the distorted data signal.

18 Claims, 17 Drawing Sheets

DISPLAY DEVICE WHICH COMPENSATES FOR DISTORTED SIGNAL USING MEASURED INFORMATION

This application claims priority to Korean Patent Application No. 10-2017-0097276, filed on Jul. 31, 2017, and all the benefits accruing therefrom under 35 U.S.C. § 119, the content of which in its entirety is herein incorporated by reference.

BACKGROUND

1. Field of Disclosure

The invention relates to a display device including a data driving circuit capable of generating a feedback signal with respect to a phase, amplitude, rising time, or falling time of a data signal.

2. Description of the Related Art

In general, a display device includes a display panel displaying an image and a driving circuit driving the display panel. The display panel includes gate lines, data lines, and pixels.

The driving circuit generally includes a data driving circuit outputting a data driving signal to the data lines, a gate driving circuit outputting a gate driving signal to the gate lines, and a signal controller controlling the data driving circuit and the gate driving circuit.

The display device applies a gate-on voltage to the pixel connected to the gate line associated with a desired image to be displayed, and applies a data voltage corresponding to the image to the pixel, thereby displaying the image.

The signal controller generally provides image signals and control signals to the data driving circuit.

In the case that the image signals are input to the data driving circuit, the image signals are distorted by a voltage drop. Particularly, as a distance between the signal controller and the data driving circuit increases, the distortion of the image signals is intensified.

SUMMARY

The invention provides a display device capable of measuring a degree of distortion of a signal applied to a data driving circuit and applying a feedback signal to a circuit in a signal controller or the data driving circuit on the basis of the measured information to compensate for the distorted signal.

According to an exemplary embodiment of the inventive concept, a display device includes a plurality of pixels, a data driving circuit, and a signal controller. The data driving circuit includes a plurality of driving chips, each of which provides a data signal to corresponding pixels among the pixels. The signal controller is connected to the driving chips by an interface and provides the data signal to the data driving circuit. At least one of the driving chips includes a monitoring circuit including a phase monitoring circuit and a clock generation circuit. The phase monitoring circuit receives the data signal from the signal controller. The clock generation circuit receives a normal clock signal and generates a first phase conversion clock signal and a second phase conversion clock signal which have phase differences from the normal clock signal. The phase monitoring circuit includes a phase sampling circuit, a phase alignment circuit, an exclusive OR circuit, and a phase register circuit. The phase sampling circuit includes a first sampling D-flip flop which receives the data signal and the normal clock signal, a second sampling D-flip flop which receives the data signal and the first phase conversion clock signal, and a third sampling D-flip flop which receives the data signal and the second phase conversion clock signal. The phase alignment circuit includes a first alignment D-flip flop which receives an output of the first sampling D-flip flop and the normal clock signal, a second alignment D-flip flop which receives an output of the second sampling D-flip flop and the normal clock signal, and a third alignment D-flip flop which receives an output of the third sampling D-flip flop and the normal clock signal. The exclusive OR circuit receives an output of the phase sampling circuit or an output of the phase alignment circuit. The phase register circuit stores data output from the exclusive OR circuit.

In an exemplary embodiment, the first phase conversion clock signal may have a phase leading a phase of the normal clock signal, and the second phase conversion clock signal may have a phase lagging behind the phase of the normal clock signal.

In an exemplary embodiment, a phase difference between the first phase conversion clock signal and the normal clock signal may be equal to a phase difference between the second phase conversion clock signal and the normal clock signal.

In an exemplary embodiment, the first phase conversion clock signal may have a phase leading the normal clock signal by about X degrees, and the second phase conversion clock signal may have a phase leading the normal clock signal by about 360-X degrees.

In an exemplary embodiment, the exclusive OR circuit may include a first exclusive OR circuit and a second exclusive OR circuit. The first exclusive OR circuit may receive the output of the first sampling D-flip flop and an output of the second alignment D-flip flop. The second exclusive OR circuit may receive an output of the first alignment D-flip flop and an output of the third alignment D-flip flop.

In an exemplary embodiment, the clock generation circuit may include a frequency divider which generates a low frequency clock signal having a frequency lower than the normal clock signal. The phase monitoring circuit may further include a phase frequency conversion circuit. The phase frequency conversion circuit may include a first phase frequency D-flip flop which receives an output of the first exclusive OR circuit and the low frequency clock signal and a second phase frequency D-flip flop which receives an output of the second exclusive OR circuit and the low frequency clock signal.

In an exemplary embodiment, the phase register circuit may include n up-count registers which sequentially stores outputs of the first phase frequency D-flip flop and n down-count registers which sequentially stores outputs of the second phase frequency D-flip flop, where n is a natural number equal to or greater than 2.

In an exemplary embodiment, a phase control signal may be input to the clock generation circuit to control a phase of the first phase conversion clock signal and a phase of the second phase conversion clock signal, the phase control signal may be an m-bit digital signal, m may be a natural number equal to or greater than 1, and a value of the n may be equal to a value of $2^m$.

In an exemplary embodiment, the display device may further include a control circuit which reads out phase data stored in the n up-count registers and the n down-count registers and outputs a feedback signal based on the readout phase data.

In an exemplary embodiment, the signal controller may further include a pre-emphasis circuit which emphasizes a portion corresponding to a predetermined frequency band of the data signal and an output driver which transmits the data signal received from the pre-emphasis circuit to the data driving circuit through the interface. At least one of the driving chips may further include an equalizer which uniformly converts frequency characteristics of the data signal received from the signal controller and a clock recovery circuit which generates the normal clock signal using the data signal received from the equalizer.

In an exemplary embodiment, the feedback signal may be input to at least one of the pre-emphasis circuit, the output driver, and the equalizer.

In an exemplary embodiment, the pre-emphasis circuit may receive the feedback signal and more emphasize the portion corresponding to the predetermined frequency band of the data signal, the output driver may receive the feedback signal and make a drive strength greater, and the equalizer may receive the feedback signal and make an AC gain greater.

In an exemplary embodiment, the at least one of the driving chips may further include an amplitude monitoring circuit including an amplitude comparison circuit. The amplitude comparison circuit may include a first comparator which receives a first reference voltage and the data signal, a second comparator which receives a second reference voltage having a level greater than the first reference voltage and the data signal, and a third comparator which receives a third reference voltage having a level greater than the second reference voltage and the data signal.

In an exemplary embodiment, each of the first comparator, the second comparator, and the third comparator may include an operational ("OP") amplifier, and the first phase conversion clock signal or the second phase conversion clock signal may be input to a power terminal of the operational amplifier.

In an exemplary embodiment, the amplitude monitoring circuit may further include an amplitude frequency conversion circuit which receives an output of the amplitude comparison circuit. The amplitude frequency conversion circuit may include a first amplitude frequency D-flip flop which receives an output of the first comparator and the low frequency clock signal, a second amplitude frequency D-flip flop which receives an output of the second comparator and the low frequency clock signal, and a third amplitude frequency D-flip flop which receives an output of the third comparator and the low frequency clock signal.

In an exemplary embodiment, the amplitude monitoring circuit may further include an amplitude register circuit which stores data output from the amplitude frequency conversion circuit. The amplitude register circuit may include k first level registers which sequentially stores outputs of the first amplitude frequency D-flip flop, k second level registers which sequentially stores outputs of the second amplitude frequency D-flip flop, and k third level registers which sequentially stores outputs of the third amplitude frequency D-flip flop, where k is a natural number equal to or greater than 2.

In an exemplary embodiment, the control circuit may read out amplitude data stored in the k first level registers, the k second level registers, and the k third level registers and outputs the feedback signal based on the readout amplitude data.

In an exemplary embodiment, a value of the k may be equal to a value of the n.

According to an exemplary embodiment of the inventive concept, a display device includes a signal controller and a data driving circuit. The signal controller transmits a data signal. The data driving circuit receives the data signal and includes a monitoring circuit and a control circuit. The monitoring circuit samples the data signal a plurality of times simultaneously using a plurality of clock signals having different phases from each other, one clock signal of the clock signals has a phase that is not changed during the plural samplings, the other clock signals of the clock signals have a phase that is continuously changed during the plural samplings, and the control circuit provides a feedback signal to the signal controller based on results of the plural sampling.

In an exemplary embodiment, the signal controller may receive the feedback signal and more emphasize a portion corresponding to a predetermined frequency band of the data signal or make a drive strength greater.

According to the above, the data signals compensated on the basis of the distance between the signal controller (or a timing controller) and the data driving circuit may be transmitted to the data driving circuit. As a result, the data signals are provided to the data driving circuit with reduced distortion, and thus an overall image quality of the display device may be improved.

BRIEF DESCRIPTION OF THE DRAWINGS

The above and other advantages of the invention will become readily apparent by reference to the following detailed description when considered in conjunction with the accompanying drawings wherein.

DETAILED DESCRIPTION

Figure 1:
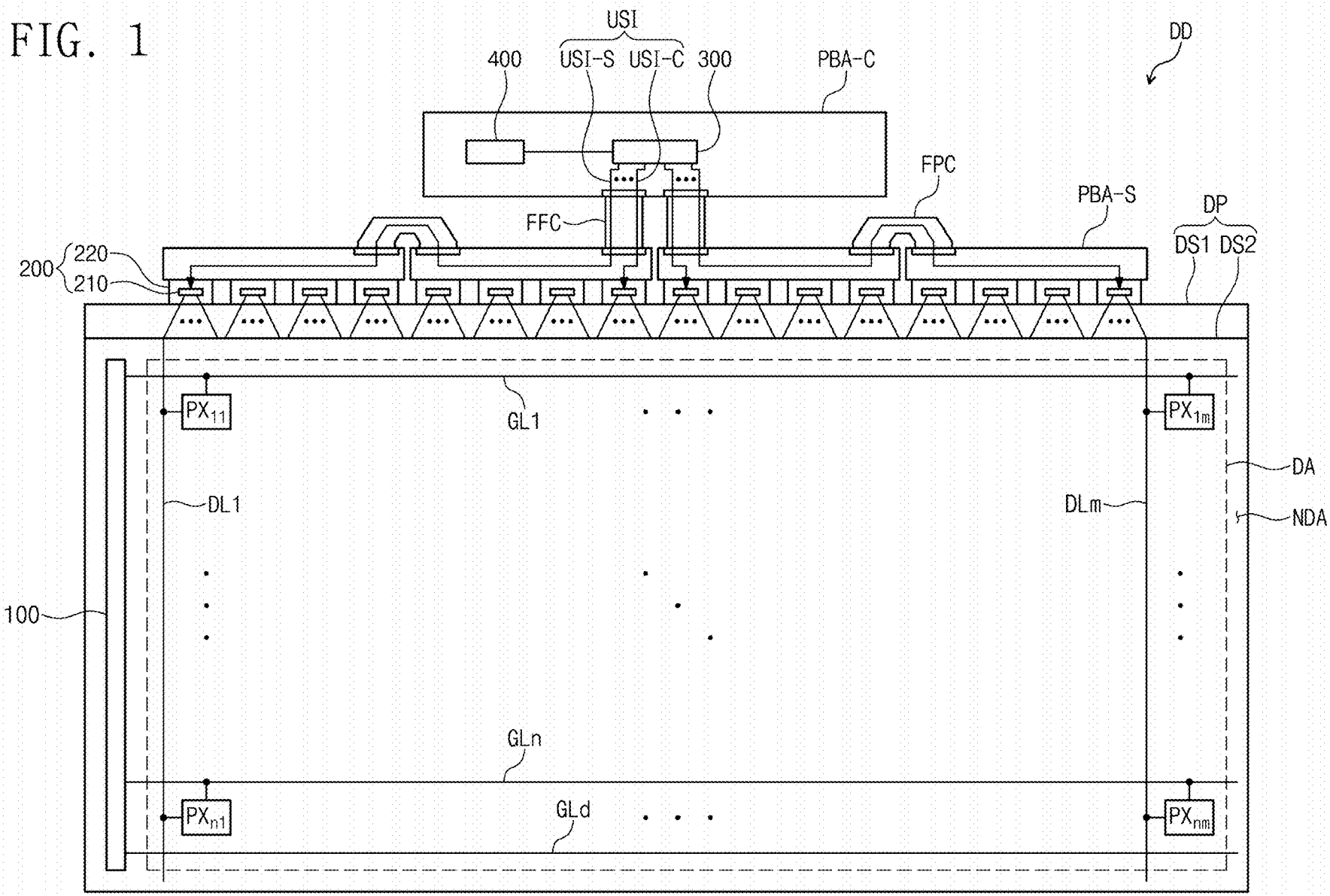
FIG. 1 is a plan view showing an exemplary embodiment of a display device according to the invention.

Hereinafter, the invention will be explained in detail with reference to the accompanying drawings.

In the drawings, the thickness of layers, films, and regions are exaggerated for clarity. As used herein, the term "and/or" includes any and all combinations of one or more of the associated listed items.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items.

Figure 2:
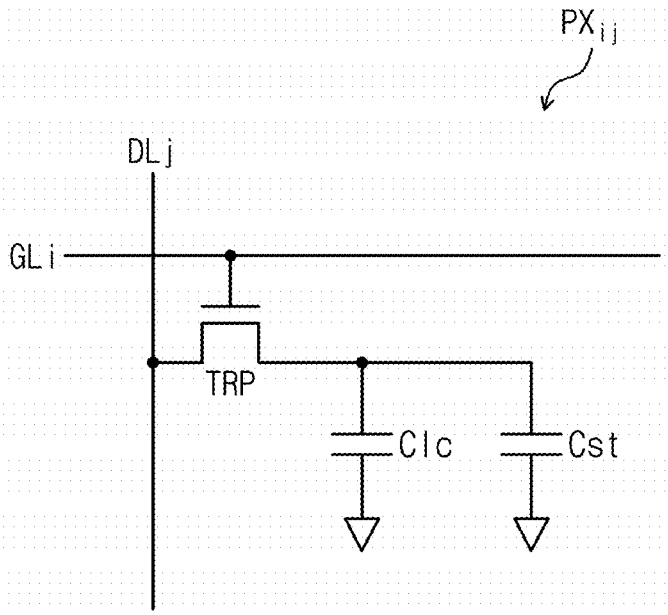
FIG. 2 is an equivalent circuit diagram showing an exemplary embodiment of a pixel according to the invention.
Figure 3:
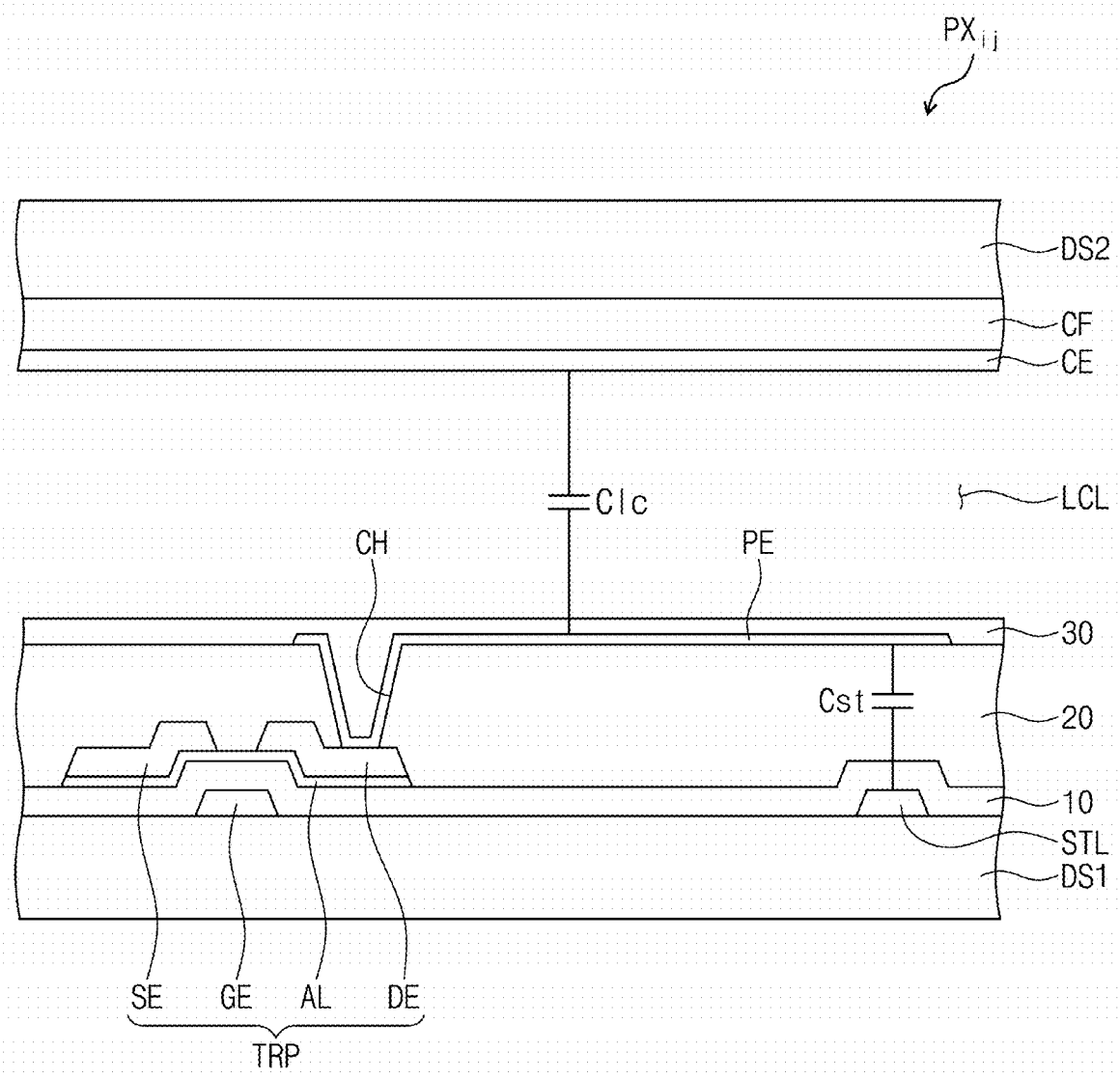
FIG. 3 is a cross-sectional view showing an exemplary embodiment of a pixel according to the invention.

FIG. 1 is a plan view showing an exemplary embodiment of a display device DD according to the invention. FIG. 2 is an equivalent circuit diagram showing an exemplary embodiment of a pixel PX according to the invention. FIG. 3 is a cross-sectional view showing an exemplary embodiment of a pixel PX according to the invention.

Referring to FIG. 1, the display device DD includes a display panel DP, a gate driving circuit 100, a data driving circuit 200, and a signal controller 300.

The display panel DP may include various display panels, e.g., a liquid crystal display panel, an organic light emitting display panel, an electrophoretic display panel, an electrowetting display panel, etc., but kinds of the display panels should not be particularly limited. In this exemplary embodiment, the liquid crystal display panel will be described as the display panel DP. A liquid crystal display device including the liquid crystal display panel may further include a polarizer (not shown) and a backlight unit (not shown).

The display panel DP includes a first substrate DS1, a second substrate DS2 spaced apart from the first substrate DS1, and a liquid crystal layer LCL disposed between the first substrate DS1 and the second substrate DS2. In a plan view, the display panel DP includes a display area DA in which a plurality of pixels $PX_{11}$ to $PX_{nm}$ is arranged and a non-display area NDA surrounding the display area DA.

The display panel DP includes a plurality of gate lines GL1 to GLn disposed on the first substrate DS1 and a plurality of data lines DL1 to DLm crossing the gate lines GL1 to GLn on the first substrate DS1. The gate lines GL1 to GLn are connected to the gate driving circuit 100. The data lines DL1 to DLm are connected to the data driving circuit 200. FIG. 1 shows some gate lines of the gate lines GL1 to GLn and some data lines of the data lines DL1 to DLm as an example. In addition, the display panel DP may further include a dummy gate line GLd disposed in the non-display area NDA of the first substrate DS1.

FIG. 1 shows some pixels of the pixels $PX_{11}$ to $PX_{nm}$ as an example. Each of the pixels $PX_{11}$ to $PX_{nm}$ is connected to a corresponding gate line among the gate lines GL1 to GLn and a corresponding data line among the data lines DL1 to DLm. However, the dummy gate line GLd is not connected to any of the pixels $PX_{11}$ to $PX_{nm}$.

The pixels $PX_{11}$ to $PX_{nm}$ may be grouped into a plurality of groups depending on colors displayed therein. Each of the pixels $PX_{11}$ to $PX_{nm}$ displays one of primary colors. The primary colors include red, green, blue, and white, but kinds of the primary colors should not be limited thereto or thereby. That is, the primary colors may further include various colors, e.g., yellow, cyan, magenta, etc.

The gate driving circuit 100 and the data driving circuit 200 receive control signals from the signal controller 300, for example, a timing controller. The signal controller 300 is mounted on a first circuit board PBA-C and receives a power source from a power management circuit 400. The first circuit board PBA-C may be a printed board assembly ("PBA"). The power management circuit 400 may be a power management integrated circuit ("PMIC").

The signal controller 300 receives image data and control signals from an external graphic controller (not shown). The control signals include a vertical synchronization signal to distinct frame periods, a horizontal synchronization signal as a row distinction signal to distinct horizontal periods, a data enable signal maintained at a high level during a period, in which data are output, to indicate a data input period, and clock signals.

The gate driving circuit 100 generates gate signals GS1 to GSn in response to the control signal (hereinafter, referred to as a "gate control signal") received from the signal controller 300 and applies the gate signals GS1 to GSn to the gate lines GL1 to GLn, respectively.

FIG. 1 shows one gate driving circuit 100 connected to left ends of the gate lines GL1 to GLn as a representative example. In another exemplary embodiment, the display device may include two gate driving circuits. One gate driving circuit of the two gate driving circuits is connected to the left ends of the gate lines GL1 to GLn, and the other gate driving circuit of the two gate driving circuits is connected to right ends of the gate lines GL1 to GLn. In addition, one gate driving circuit of the two gate driving circuits may be connected to odd-numbered gate lines of the gate lines GL1 to GLn, and the other gate driving circuit of the two gate driving circuits may be connected to even-numbered gate lines of the gate lines GL1 to GLn.

The data driving circuit 200 generates grayscale voltages corresponding to the image data provided from the signal controller 300 in response to the control signal (hereinafter, referred to as a "data control signal") received from the signal controller 300. The data driving circuit 200 outputs the grayscale voltages to the data lines DL1 to DLm as data voltages.

In the invention, a signal input to the signal controller 300, the data driving circuit 200, and the pixel $PX_{nm}$ from the external graphic controller may be referred to as a data signal. Although the data signal may be altered or modified while being transferred to the pixel $PX_{nm}$ from the external graphic controller, the data signal eventually includes data used to display an image corresponding to the data through the display area DA.

The data driving circuit 200 includes a driving chip 210 and a flexible printed circuit board 220 on which the driving chip 210 is mounted. Each of the driving chip 210 and the flexible printed circuit board 220 may be provided in a plural number. The flexible printed circuit board 220 electrically connects a second circuit board PBA-S and the first substrate DS1.

Each of the flexible printed circuit boards 220 may be connected to one second circuit board PBA-S or not. Two second circuit boards PBA-S adjacent to each other may be connected to each other by another flexible printed circuit board FPC.

The second circuit board PBA-S may be connected to the first circuit board PBA-C by a flexible flat cable FFC.

The driving chips 210 apply corresponding data signals to corresponding data lines of the data lines DL1 to DLm.

The signal controller 300 and the driving chips 210 may be connected to each other by interfaces USI. The interfaces USI include a center interface USI-C that connects the signal controller 300 to the driving chip 210 located close to the signal controller 300 and a side interface USI-S that connects the signal controller 300 to the driving chip 210 located far from the signal controller 300.

FIG. 1 shows a tape carrier package ("TCP") type of the data driving circuit 200 as a representative example. In another exemplary embodiment of the invention, the driving chip 210 may be disposed on the non-display area NDA of the first substrate DS1 in a chip-on-glass ("COG") method.

FIG. 2 is an equivalent circuit diagram showing an exemplary embodiment of the pixel $PX_{ij}$ according to the invention. FIG. 3 is a cross-sectional view showing an exemplary embodiment of the pixel $PX_{ij}$ according to the invention. Each of the pixels $PX_{11}$ to $PX_{nm}$ shown in FIG. 1 may have the equivalent circuit shown in FIG. 2.

Referring to FIG. 2, the pixel $PX_{ij}$ includes a pixel thin film transistor TRP (hereinafter, referred to as a "pixel transistor"), a liquid crystal capacitor Clc, and a storage capacitor Cst. Hereinafter, the term "transistor" used herein indicates a thin film transistor. In the exemplary embodiment of the invention, the storage capacitor Cst may be omitted. The pixel transistor TRP is electrically connected to an i-th gate line GLi and a j-th data line DLj. The pixel transistor TRP outputs a pixel voltage corresponding to the data signal provided through the j-th data line DLj in response to the gate signal provided through the i-th gate line GLi.

The liquid crystal capacitor Clc is charged with the pixel voltage output from the pixel transistor TRP. An alignment of liquid crystal directors included in the liquid crystal layer LCL (refer to FIG. 3) is changed depending on an amount of electric charge charged in the liquid crystal capacitor Clc.

The storage capacitor Cst is connected to the liquid crystal capacitor Clc in parallel. The storage capacitor Cst maintains the alignment of the liquid crystal directors for a predetermined period.

Referring to FIG. 3, the pixel transistor TRP includes a control electrode GE connected to the i-th gate line GLi (refer to FIG. 2), an active layer AL overlapping with the control electrode GE, an input electrode SE connected to the j-th data line DLj (refer to FIG. 2), and an output electrode DE disposed spaced apart from the input electrode SE.

The liquid crystal capacitor Clc includes a pixel electrode PE and a common electrode CE. The storage capacitor Cst includes the pixel electrode PE and a portion of a storage line STL overlapped with the pixel electrode PE.

The i-th gate line GLi and the storage line STL are disposed on a surface of the first substrate DS1. The control electrode GE is branched from the i-th gate line GLi. In an exemplary embodiment, the i-th gate line GLi and the storage line STL include a metal material, such as aluminum (Al), silver (Ag), copper (Cu), molybdenum (Mo), chromium (Cr), tantalum (Ta), titanium (Ti), or an alloy thereof. Each of the i-th gate line GLi and the storage line STL has a multi-layer structure, for example, a structure including a titanium layer and a copper layer.

A first insulating layer 10 is disposed on the first substrate DS1 to cover the control electrode GE and the storage line STL. The first insulating layer 10 includes at least one of an inorganic material and an organic material. The first insulating layer 10 is an organic or inorganic layer. The first insulating layer 10 has a multi-layer structure, for example, a structure including a silicon nitride layer and a silicon oxide layer.

The active layer AL is disposed on the first insulating layer 10 to overlap with the control electrode GE. The active layer AL includes a semiconductor layer (not shown) and an ohmic contact layer (not shown).

In an exemplary embodiment, the active layer AL includes amorphous silicon or polysilicon. In addition, the active layer AL may include a metal oxide semiconductor.

The output electrode DE and the input electrode SE are disposed on the active layer AL. The output electrode DE and the input electrode SE are disposed to be spaced apart from each other. Each of the output electrode DE and the input electrode SE partially overlaps with the control electrode GE.

FIG. 3 shows the pixel transistor TRP having the staggered structure, but the structure of the pixel transistor TRP should not be limited to the staggered structure. That is, the pixel transistor TRP may have a planar structure in another exemplary embodiment.

A second insulating layer 20 is disposed on the first insulating layer 10 to cover the active layer AL, the output electrode DE, and the input electrode SE. The second insulating layer 20 may provide an evenness surface. The second insulating layer 20 may include an organic material.

The pixel electrode PE is disposed on the second insulating layer 20. The pixel electrode PE is connected to the output electrode DE through a contact hole CH defined through the second insulating layer 20. An alignment layer 30 is disposed on the second insulating layer 20 to cover the pixel electrode PE.

A color filter layer CF may be disposed on a surface of the second substrate DS2. The common electrode CE is disposed on the color filter layer CF. The common electrode CE is applied with a common voltage. The common voltage has a level different from that of the pixel voltage. An alignment layer (not shown) may be disposed on the common electrode CE to cover the common electrode CE. Another insulating layer may be disposed between the color filter layer CF and the common electrode CE.

The pixel electrode PE and the common electrode CE, which face each other such that the liquid crystal layer LCL is disposed between the pixel electrode PE and the common electrode CE, form the liquid crystal capacitor Clc. In addition, the pixel electrode PE and the portion of the storage line STL, which face each other such that the first and second insulating layers 10 and 20 are disposed between the pixel electrode PE and the portion of the storage line STL, form the storage capacitor Cst. The storage line STL receives a storage voltage having a level different from that of the pixel voltage. The storage voltage may have the same level as that of the common voltage.

FIG. 3 shows a cross-section of the pixel $PX_{ij}$ as a representative example. Different from the structure of the pixel $PX_{ij}$ shown in FIG. 2, at least one of the color filter layer CF and the common electrode CE may be disposed on the first substrate DS1 in another exemplary embodiment. In other words, the liquid crystal display panel according to exemplary embodiments may include a vertical alignment ("VA") mode pixel, a patterned vertical alignment ("PVA") mode pixel, an in-plane switching ("IPS") mode pixel, a fringe-field switching ("FFS") mode pixel, or a plane-to-line switching ("PLS") mode pixel.

Figure 4A:
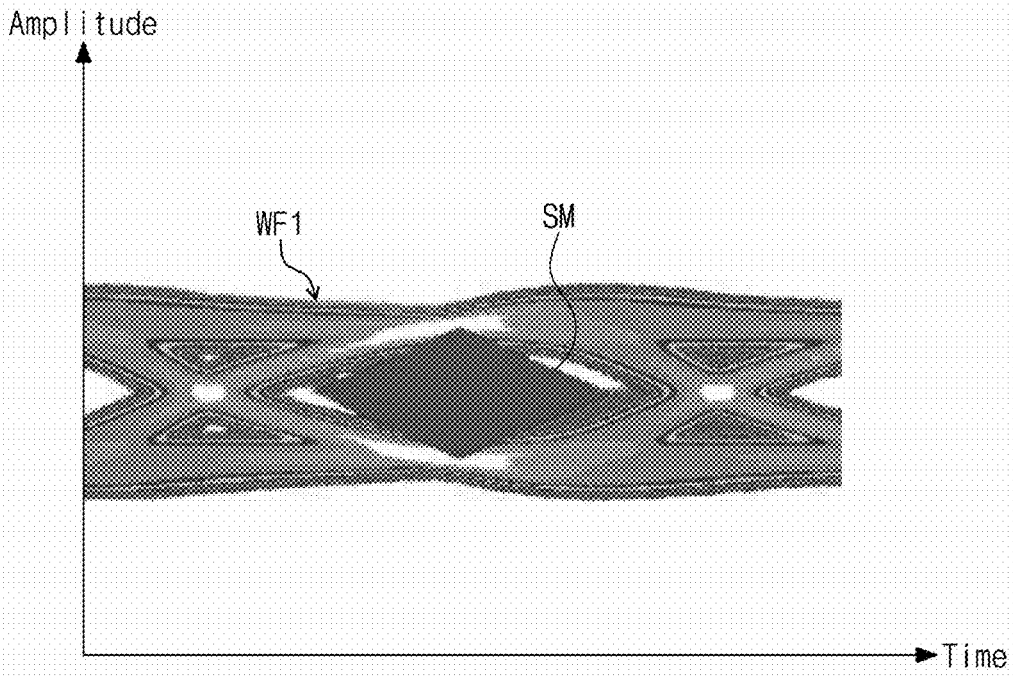
FIGS. 4A and 4B are eye diagrams of data signals output from a signal controller according to an exemplary embodiment of the invention.
Figure 4B:
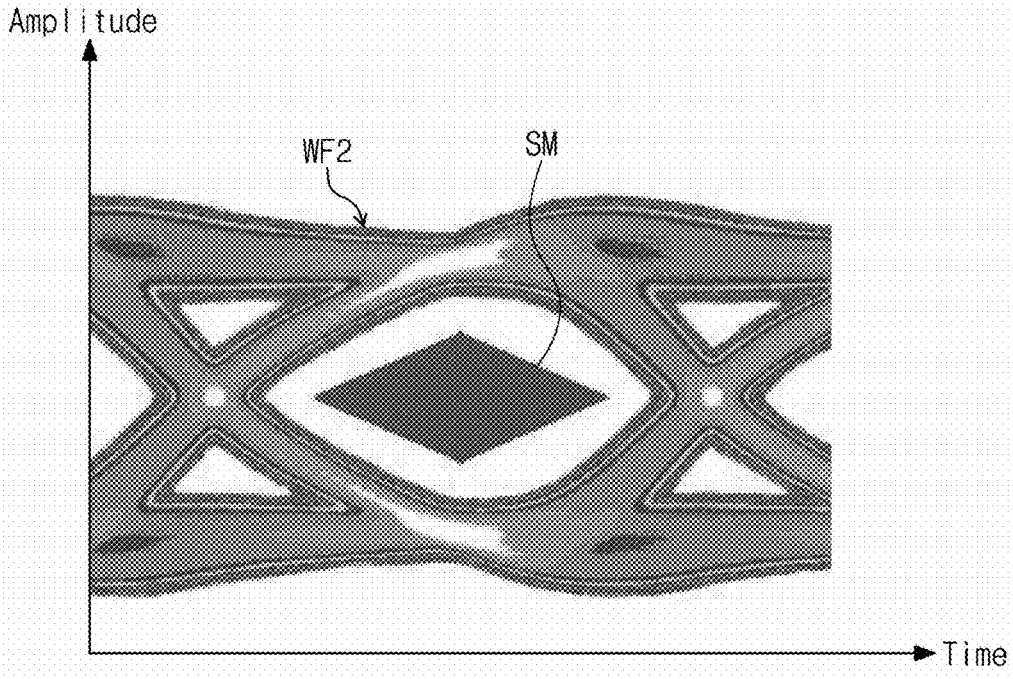

FIGS. 4A and 4B are eye diagrams of data signals output from the signal controller 300 shown in FIG. 1.

Each of the data signals may be represented by a data value of 0 or 1. The eye diagrams may be graphs representing voltage waveforms WF1 and WF2 corresponding to data value of the data signals, respectively.

A lozenge shape in the center in FIGS. 4A and 4B may be a reference margin SM needed to allow the data signals output from the signal controller 300 to be normally provided to the data driving circuit 200. That is, in a case that the voltage waveform of the data signals does not invade the reference margin SM, the data signals that are normal may be provided to the data driving circuit 200. On the contrary, in a case that the voltage waveform of the data signals invades the reference margin SM, the data signals that are distorted may be provided to the data driving circuit 200. In general, since a voltage drop occurs when the data signals are input to the driving chips 210 of the data driving circuit 200 through signal lines, the image signals may be distorted. In addition, a degree of distortion of the data signal input to each of the driving chips 210 is different depending on a difference in length between the center interface USI-C and the side interface USI-S.

According to an exemplary embodiment of the invention, when the data signals are distorted as shown in FIG. 4A, the degree of distortion may be determined by measuring the phase, amplitude, rising time, or falling time of the distorted signal. When the data signals are compensated based on the degree of distortion measured, the normal data signals may be provided to the data driving circuit 200 as shown in FIG. 4B.

Figure 5A:
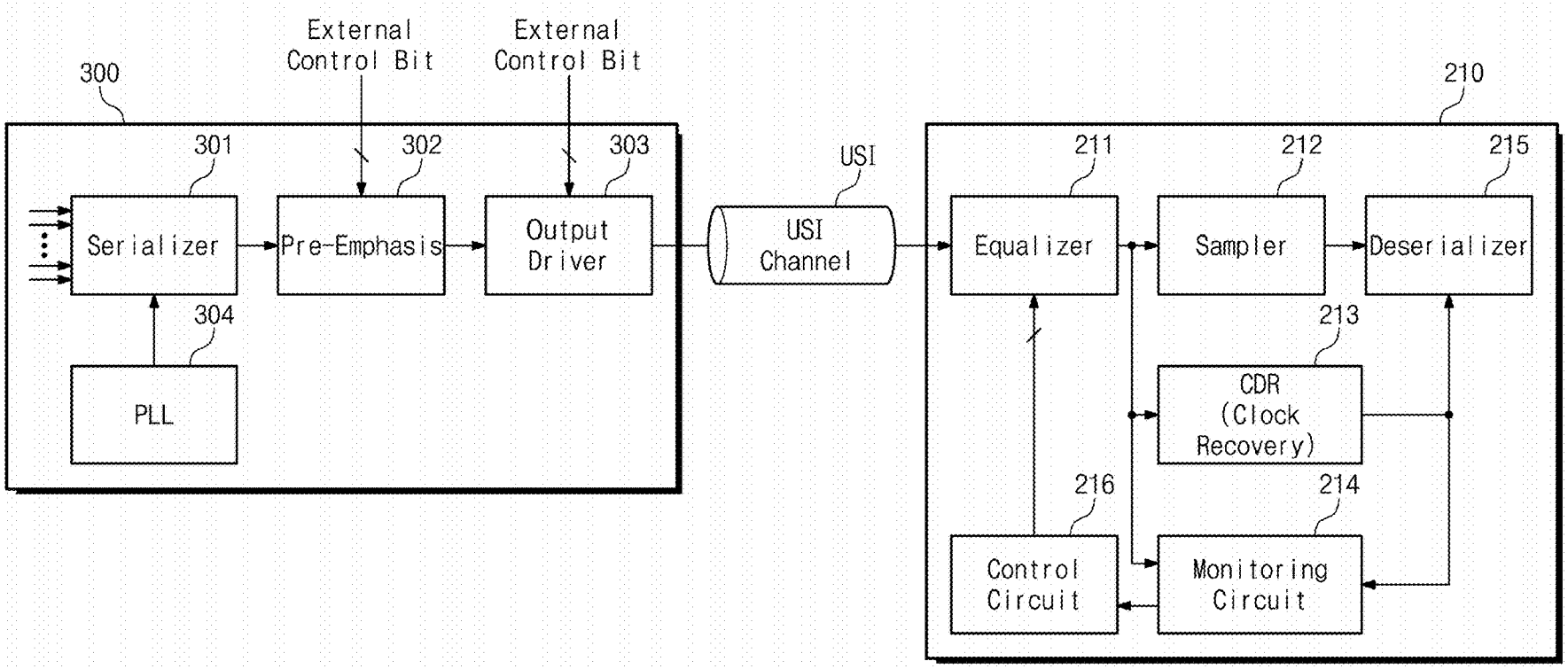
FIGS. 5A and 5B are block diagrams showing a signal controller and a driving chip according to an exemplary embodiment of the invention.
Figure 5B:
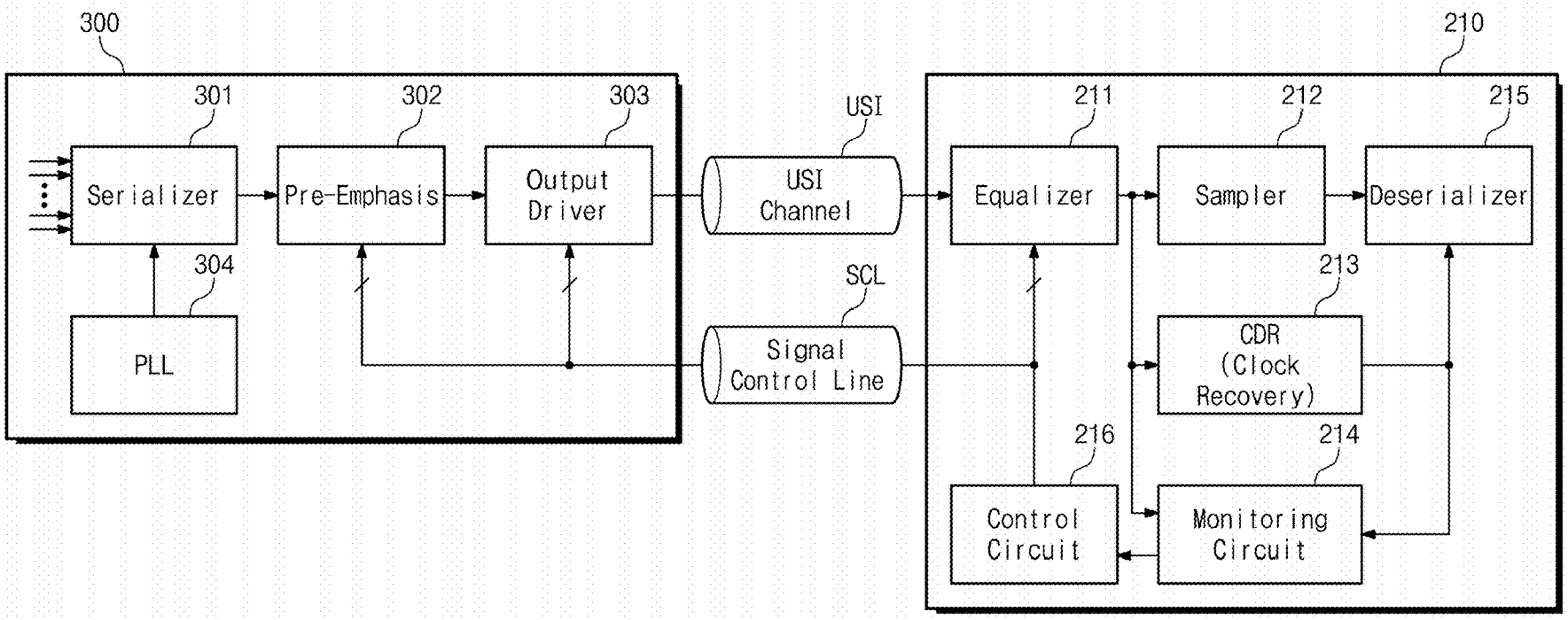

FIGS. 5A and 5B are block diagrams showing exemplary embodiments of the signal controller 300 and the driving chip 210 according to the invention.

Referring to FIGS. 5A and 5B, the signal controller 300 includes a serializer 301, a pre-emphasis circuit 302, an output driver 303, and a phase-locked loop 304.

The serializer 301 converts the data signal in parallel form to the data signal in serial form sequentially by time order.

The pre-emphasis circuit 302 may emphasize a portion corresponding to a certain frequency band of the data signal in serial form, which is provided from the serializer 301. A signal-to-noise ratio ("SNR"), frequency characteristics, and distortion characteristics may be improved by the emphasis of the pre-emphasis circuit 302.

The output driver 303 receives the data signal, of which the portion corresponding to the certain frequency band is emphasized, from the pre-emphasis circuit 302 and transmits the data signal to the driving chip 210 of the data driving circuit 200 through the interface USI.

The phase-locked loop circuit 304 may be, but not limited to, a frequency negative feedback circuit configured to maintain the frequency of the output signal at a constant level. In detail, the phase-locked loop circuit 304 detects a phase difference between the input signal and the output signal and controls a voltage-controlled oscillator to output a constant frequency signal. The phase-locked loop circuit 304 may be referred to as PLL in an abbreviation form.

The driving chip 210 may include an equalizer 211, a sampler 212, a clock recovery circuit 213, a monitoring circuit 214, a deserializer 215, and a control circuit 216.

The equalizer 211 may adjust the frequency characteristics of the data signal received thereto to be equalized in a required range.

The sampler 212 may sample the data signal received from the equalizer 211.

The clock recovery circuit 213 may generate a normal clock signal using the data signal received from the equalizer 211. The normal clock signal will be described in detail later. The clock recovery circuit 213 may be referred to as CDR in an abbreviation form.

The monitoring circuit 214 receives the data signal from the equalizer 211 and a plurality of clock signals from the clock recovery circuit 213. The clock signals include the normal clock signal, and these will be described in detail later. The monitoring circuit 214 may measure at least one of the phase, amplitude, rising time, and falling time of the received data signal. The monitoring circuit 214 may include a clock generation circuit CGC (refer to FIG. 6A), a phase monitoring circuit PMC (refer to FIG. 7), and an amplitude monitoring circuit AMC (refer to FIG. 7), and these circuits included in the monitoring circuit 214 will be described in detail later.

The deserializer 215 may convert the received data signal in the serial form to the data signal in parallel form.

The control circuit 216 may generates a feedback signal based on information measured by the monitoring circuit 214.

Referring to FIG. 5A, the control circuit 216 may transmit the feedback signal to the equalizer 211.

Referring to FIG. 5B, the control circuit 216 may transmit the feedback signal to the equalizer 211, the pre-emphasis circuit 302, and the output driver 303. The control circuit 216 transmits the feedback signal to the pre-emphasis circuit 302 and the output driver 303 through a signal control line SCL. In an exemplary embodiment of the invention, the signal control line SCL may be, but not limited to, an interface.

However, the transmission path of the feedback signal by the control circuit 216 should not be limited thereto or thereby. That is, the control circuit 216 may transmit the feedback signal to at least one of components of the driving chip 210 and components of the signal controller 300 in another exemplary embodiment.

Figure 6A:
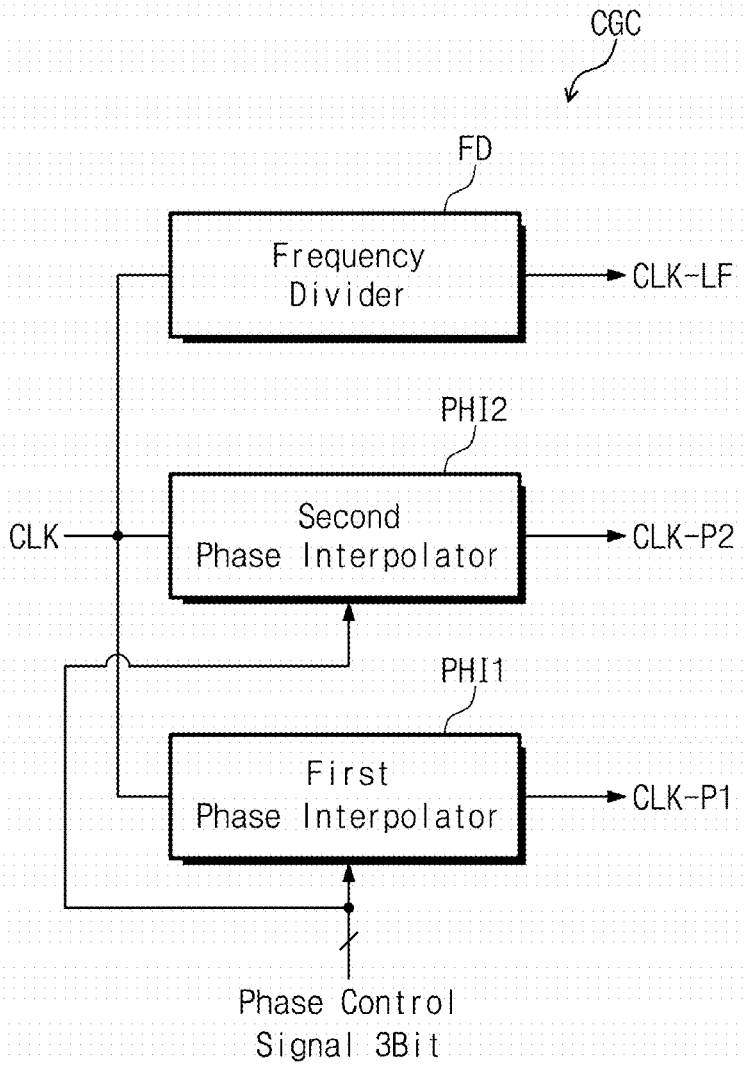
FIG. 6A is a block diagram showing an exemplary embodiment of a clock generation circuit according to the invention.
Figure 6B:
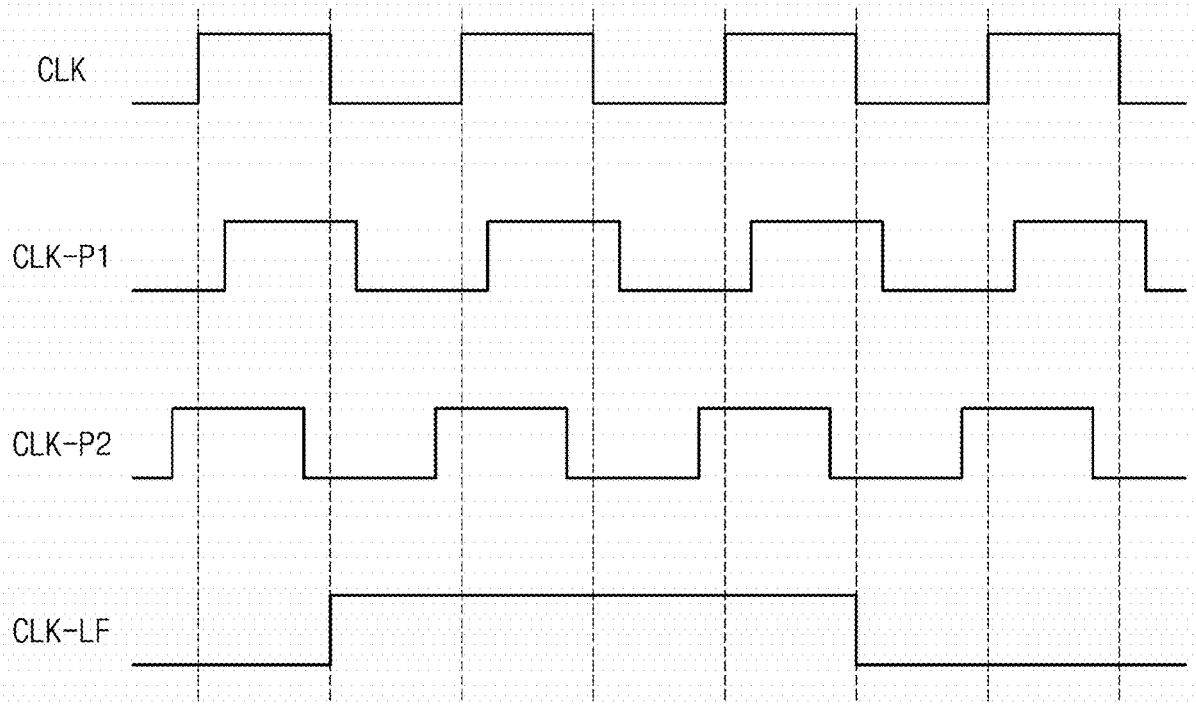
FIG. 6B is a waveform diagram showing an exemplary embodiment of input/output clock signals of the clock generation circuit shown in FIG. 6A.

FIG. 6A is a block diagram showing an exemplary embodiment of the clock generation circuit CGC according to the invention. FIG. 6B is a waveform diagram showing an exemplary embodiment of input/output clock signals CLK, CLK-P1, CLK-P2, and CLK-LF of the clock generation circuit CGC shown in FIG. 6A.

The clock generation circuit CGC may include phase interpolators PHI1 and PHI2 and a frequency divider FD. The phase interpolators PHI1 and PHI2 may include a first phase interpolator PHI1 and a second phase interpolator PHI2.

The first phase interpolator PHI1 receives the normal clock signal CLK and generates a first phase conversion clock signal CLK-P1. A phase of the first phase conversion clock signal CLK-P1 may lead a phase of the normal clock signal CLK. For instance, a difference in phase between the first phase conversion clock signal CLK-P1 and the normal clock signal CLK may be about X degrees.

The phase of the first phase conversion clock signal CLK-P1 generated by the first phase interpolator PHI1 may be gradually changed depending on a value of a phase control signal. In an exemplary embodiment of the invention, the phase of the first phase conversion clock signal CLK-P1 generated by the first phase interpolator PHI1 may gradually lead the phase of the normal clock signal CLK.

The second phase interpolator PHI2 receives the normal clock signal CLK and generates a second phase conversion clock signal CLK-P2. A phase of the second phase conversion clock signal CLK-P2 may lag behind the phase of the normal clock signal CLK. For instance, a difference in phase between the second phase conversion clock signal CLK-P2 and the normal clock signal CLK may be about Y degrees.

The phase of the second phase conversion clock signal CLK-P2 generated by the second phase interpolator PHI2 may be gradually changed depending on the value of the phase control signal. In an exemplary embodiment of the invention, the phase of the second phase conversion clock signal CLK-P2 generated by the second phase interpolator PHI2 may gradually lag behind the phase of the normal clock signal CLK.

In an exemplary embodiment of the invention, a direction to which the phase of the first phase conversion clock signal CLK-P1 is changed may be opposite to a direction to which the phase of the second phase conversion clock signal CLK-P2 is changed.

In an exemplary embodiment of the invention, the phase of the first phase conversion clock signal CLK-P1 may lead the phase of the normal clock signal CLK by about X degrees, and the phase of the second phase conversion clock signal CLK-P2 may lead the phase of the normal clock signal CLK by about 360-X degrees.

The frequency divider FD receives the normal clock signal CLK and generates a low frequency clock signal CLK-LF having a frequency lower than that of the normal clock signal CLK.

Figure 7:
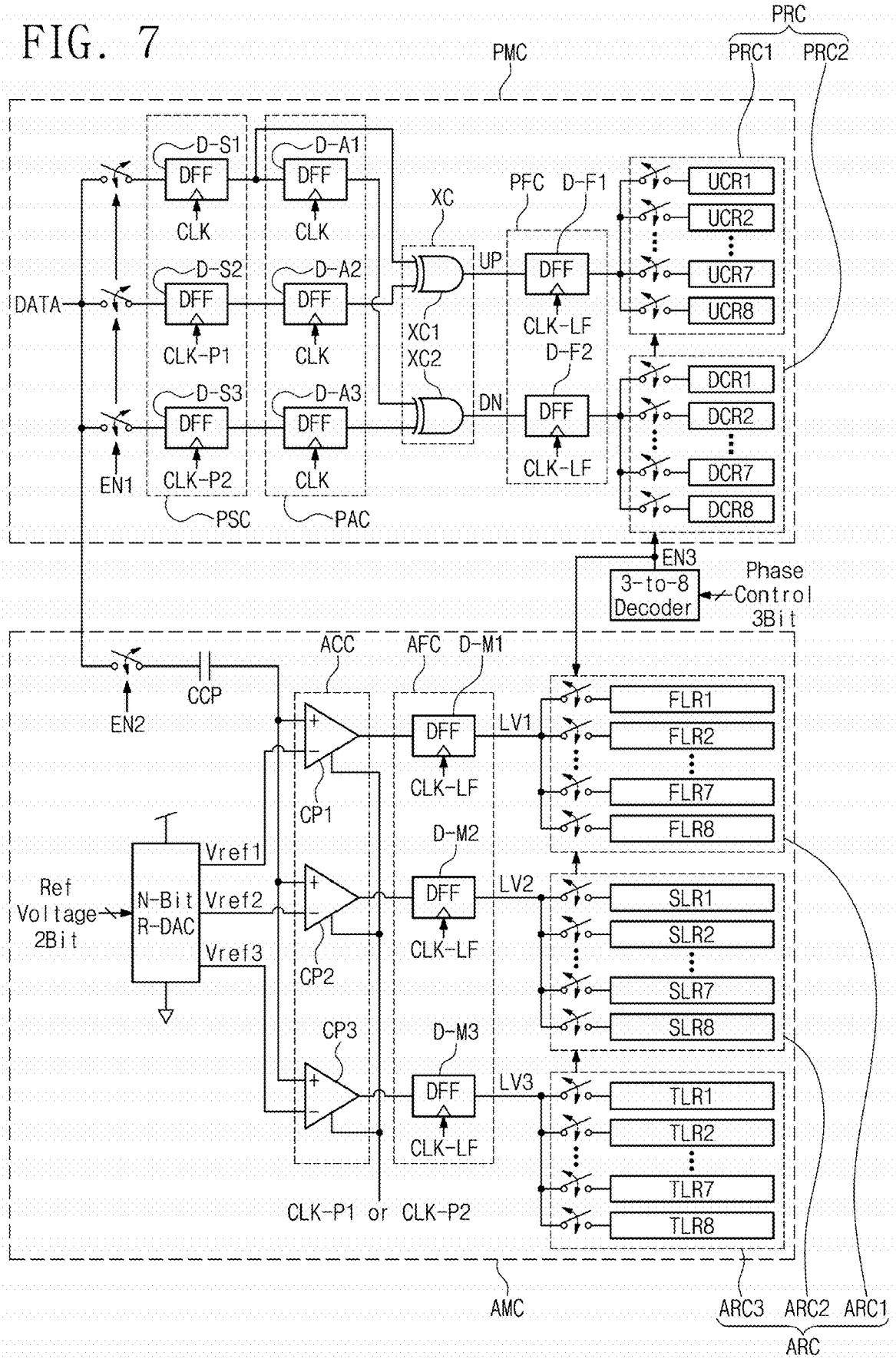
FIG. 7 is a circuit diagram showing an exemplary embodiment of a phase monitoring circuit and an amplitude monitoring circuit according to the invention.

FIG. 7 is a circuit diagram showing an exemplary embodiment of the phase monitoring circuit PMC and the amplitude monitoring circuit AMC according to the invention.

The phase monitoring circuit PMC may measure a degree of variation in phase of a data signal DATA. That is, the phase monitoring circuit PMC may measure a phase jitter.

The amplitude monitoring circuit AMC may measure a degree of variation in amplitude of the data signal DATA. That is, the amplitude monitoring circuit AMC may measure an amplitude jitter.

The jitter indicates a degree to which a signal varies from a reference value on a time axis.

The phase monitoring circuit PMC may include a phase sampling circuit PSC, a phase alignment circuit PAC, an exclusive OR circuit XC, a phase frequency conversion circuit PFC, and a phase register circuit PRC.

The phase sampling circuit PSC may include a first sampling D-flip flop D-S1, a second sampling D-flip flop D-S2, and a third sampling D-flip flop D-S3. The first sampling D-flip flop D-S1 may receive the data signal DATA and the normal clock signal CLK. The second sampling D-flip flop D-S2 may receive the data signal DATA and the first phase conversion clock signal CLK-P1. The third sampling D-flip flop D-S3 may receive the data signal DATA and the second phase conversion clock signal CLK-P2. A D-flip flop may be referred to as DFF in an abbreviation form.

The first sampling D-flip flop D-S1, the second sampling D-flip flop D-S2, and the third sampling D-flip flop D-S3 may periodically and simultaneously receive the data signal DATA in response to a first active signal EN1.

FIG. 7 shows three sampling D-flip flops D-S1, D-S2, and D-S3 as a representative example, but the number of the sampling D-flip flops included in the phase sampling circuit PSC should not be limited to three.

The phase alignment circuit PAC allows signals output from the phase sampling circuit PSC to be compared to each other at the same phase. The phase alignment circuit PAC includes a first alignment D-flip flop D-A1, a second alignment D-flip flop D-A2, and a third alignment D-flip flop D-A3.

The first alignment D-flip flop D-A1 may receive an output of the first sampling D-flip flop D-S1 and the normal clock signal CLK. The second alignment D-flip flop D-A2 may receive an output of the second sampling D-flip flop D-S2 and the normal clock signal CLK. The third alignment D-flip flop D-A3 may receive an output of the third sampling D-flip flop D-S3 and the normal clock signal CLK.

The exclusive OR circuit XC performs an exclusive OR calculation on the signals output from the phase alignment circuit PAC. The exclusive OR circuit XC includes a first exclusive OR circuit XC1 and a second exclusive OR circuit XC2.

In this exemplary embodiment of the invention shown in FIG. 7, the first exclusive OR circuit XC1 receives the output of the first sampling D-flip flop D-S1 and an output of the second alignment D-flip flop D-A2, and the second exclusive OR circuit XC2 receives an output of the first alignment D-flip flop D-A1 and an output of the third alignment D-flip flop D-A3. However, the connection relation between the exclusive OR circuit XC and the phase alignment circuit PAC should not be limited thereto or thereby, and the signals output from the phase alignment circuit PAC may be input to the exclusive OR circuit XC through various ways in another exemplary embodiment.

The phase frequency conversion circuit PFC may lower a frequency of the signal output from the exclusive OR circuit XC. In a case that the signal has too high frequency, an error may occur when the signal is stored in the phase register circuit PRC. Accordingly, when the frequency of the signal stored in the phase register circuit PRC is lowered by the phase frequency conversion circuit PFC, a stability of a system may be improved.

The phase frequency conversion circuit PFC may include a first phase frequency D-flip flop D-F1 and a second phase frequency D-flip flop D-F2. The first phase frequency D-flip flop D-F1 may receive an output of the first exclusive OR circuit XC1 and the low frequency clock signal CLK-LF. The second phase frequency D-flip flop D-F2 may receive an output of the second exclusive OR circuit XC2 and the low frequency clock signal CLK-LF.

The phase register circuit PRC may include a first phase register circuit PRC1 and a second phase register circuit PRC2.

The first phase register circuit PRC1 may include a plurality of up-count registers UCR1 to UCR8. The second phase register circuit PRC2 may include a plurality of down-count registers DCR1 to DCR8.

The number of the up-count registers UCR1 to UCR8 may be equal to the number of the down-count registers DCR1 to DCR8. FIG. 7 shows eight up-count registers UCR1 to UCR8 and eight down-count registers DCR1 to DCR8, but the number of up-count registers and down-count registers should not be limited thereto or thereby.

The amplitude monitoring circuit AMC includes an amplitude comparison circuit ACC, an amplitude frequency conversion circuit AFC, and an amplitude register circuit ARC.

The amplitude comparison circuit ACC compares reference voltages Vref1, Vref2, and Vref3 to the amplitude of the data signals DATA. The reference voltages Vref1, Vref2, and Vref3 may have different levels from each other. In an exemplary embodiment, for example, the level of the second reference voltage Vref2 is higher than the level of the first reference voltage Vref1, and the level of the third reference voltage Vref3 is higher than the level of the second reference voltage Vref2.

The amplitude comparison circuit ACC includes a plurality of comparators CP1, CP2, and CP3. FIG. 7 shows three comparators CP1, CP2, and CP3, however, the number of the comparators included in the amplitude comparison circuit ACC should not be limited to three.

The first comparator CP1 receives the first reference voltage Vref1 and the data signals DATA as its input signals. The second comparator CP2 receives the second reference voltage Vref2 and the data signals DATA as its input signals. The third comparator CP3 receives the third reference voltage Vref3 and the data signals DATA as its input signals. Each of the first, second, and third comparators CP1, CP2, and CP3 includes an OP amplifier.

The first phase conversion clock signal CLK-P1 or the second phase conversion clock signal CLK-P2 is input to a power terminal of each of the first, second, and third comparators CP1, CP2, and CP3. In an exemplary embodiment, for instance, when the data signal DATA is at a rising edge, the first phase conversion clock signal CLK-P1 is applied, and when the data signal DATA is at a falling edge, the second phase conversion clock signal CLK-P2 is applied.

The first, second, and third comparators CP1, CP2, and CP3 may periodically and simultaneously receive the data signals DATA in response to a second active signal EN2. The first, second, and third comparators CP1, CP2, and CP3 may receive the data signals DATA that pass through an AC coupling capacitor CCP.

The amplitude frequency conversion circuit AFC may lower a frequency of the signal output from the amplitude comparison circuit ACC. In a case that the signal output has too high frequency, an error may occur when the signal is stored in the amplitude register circuit ARC. Accordingly, when the frequency of the signal stored in the amplitude register circuit ARC is lowered by the amplitude frequency conversion circuit AFC, a stability of the system may be improved.

The amplitude frequency conversion circuit AFC may include a first amplitude frequency D-flip flop D-M1, a second amplitude frequency D-flip flop D-M2, and a third amplitude frequency D-flip flop D-M3. The first amplitude frequency D-flip flop D-M1 may receive an output of the first comparator CP1 and the low frequency clock signal CLK-LF. The second amplitude frequency D-flip flop D-M2 may receive an output of the second comparator CP2 and the low frequency clock signal CLK-LF. The third amplitude frequency D-flip flop D-M3 may receive an output of the third comparator CP3 and the low frequency clock signal CLK-LF.

The amplitude register circuit ARC includes a first amplitude register circuit ARC1, a second amplitude register circuit ARC2, and a third amplitude register circuit ARC3. The first amplitude register circuit ARC1 includes a plurality of first level registers FLR1 to FLR8. The second amplitude register circuit ARC2 includes a plurality of second level registers SLR1 to SLR8. The third amplitude register circuit ARC3 includes a plurality of third level registers TLR1 to TLR8. FIG. 7 shows eight first level registers FLR1 to FLR8, eight second level registers SLR1 to SLR8, and eight third level registers TLR1 to TLR8, but the number of each of the first, second, and third level registers should not be limited to eight. Referring to FIG. 6A, the phase control signal has three bits in the clock generation circuit CGC as a representative example. Accordingly, each of the number of the up-count registers and the number of the down-count registers is eight corresponding to $2^3$, and each of the number of the first level registers, the number of the second level registers, and the number of the third level registers is eight corresponding to $2^3$. In another exemplary embodiment of the invention, when the phase control signal has m bits, each of the number of the up-count registers and the number of the down-count registers may be $2^m$, and each of the number of the first level registers, the number of the second level registers, and the number of the third level registers may also be $2^m$.

Outputs of the first phase frequency D-flip flop D-F1 may be sequentially stored in the up-count registers UCR1 to UCR8. Outputs of the second phase frequency D-flip flop D-F2 may be sequentially stored in the down-count registers DCR1 to DCR8. The sequential storing of the outputs may be controlled by a third active signal EN3 provided from a decoder.

Outputs of the first amplitude frequency D-flip flop D-M1 may be sequentially stored in the first level registers FLR1 to FLR8. Outputs of the second amplitude frequency D-flip flop D-M2 may be sequentially stored in the second level registers SLR1 to SLR8. Outputs of the third amplitude frequency D-flip flop D-M3 may be sequentially stored in the third level registers TLR1 to TLR8. The sequential storing of the outputs may be controlled by the third active signal EN3 provided from the decoder.

Figure 10A:
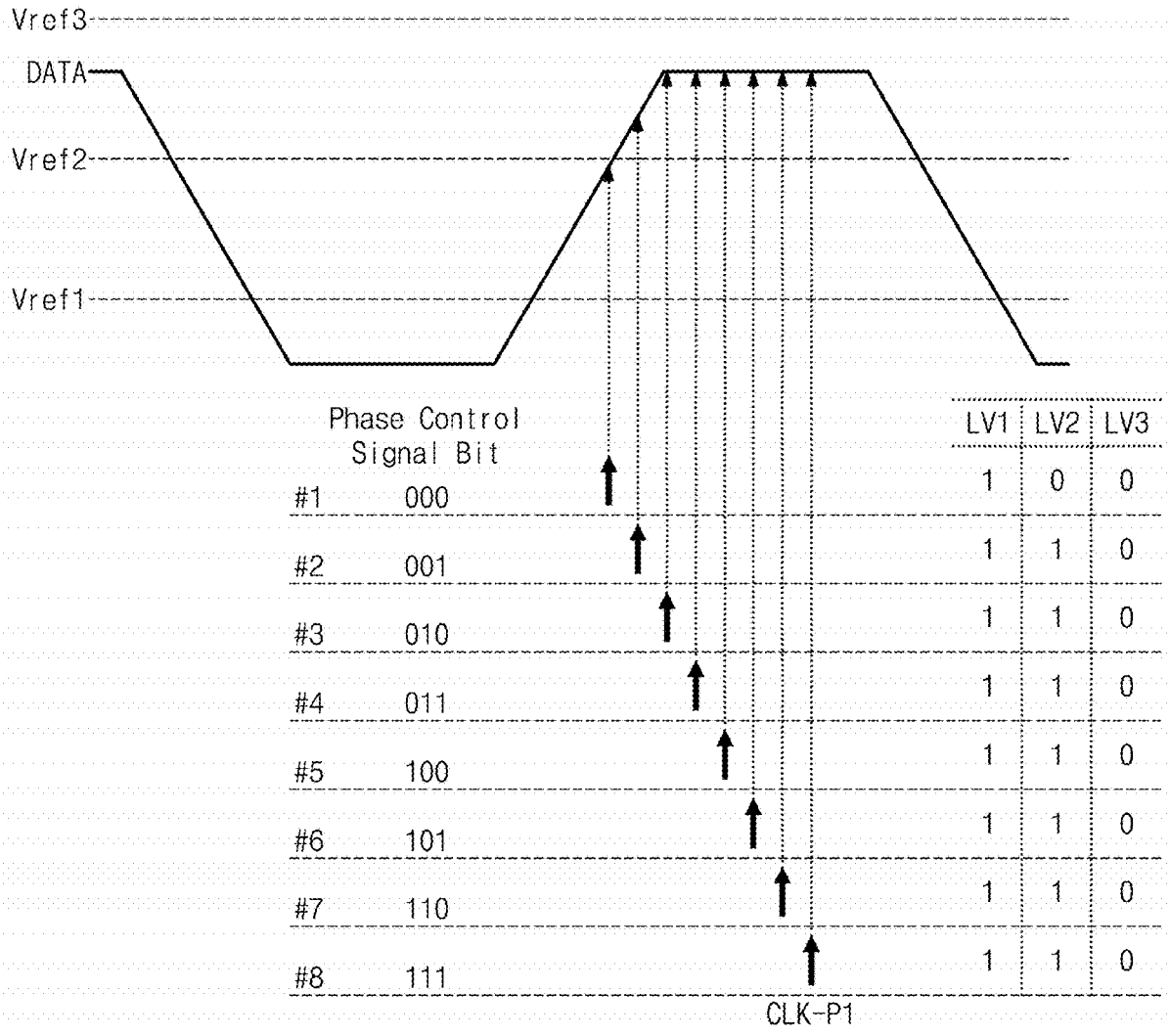
FIGS. 10A and 10B are views showing an exemplary embodiment of a method of determining an amount of an amplitude jitter using a control circuit based on data stored in an amplitude register circuit.
Figure 10B:
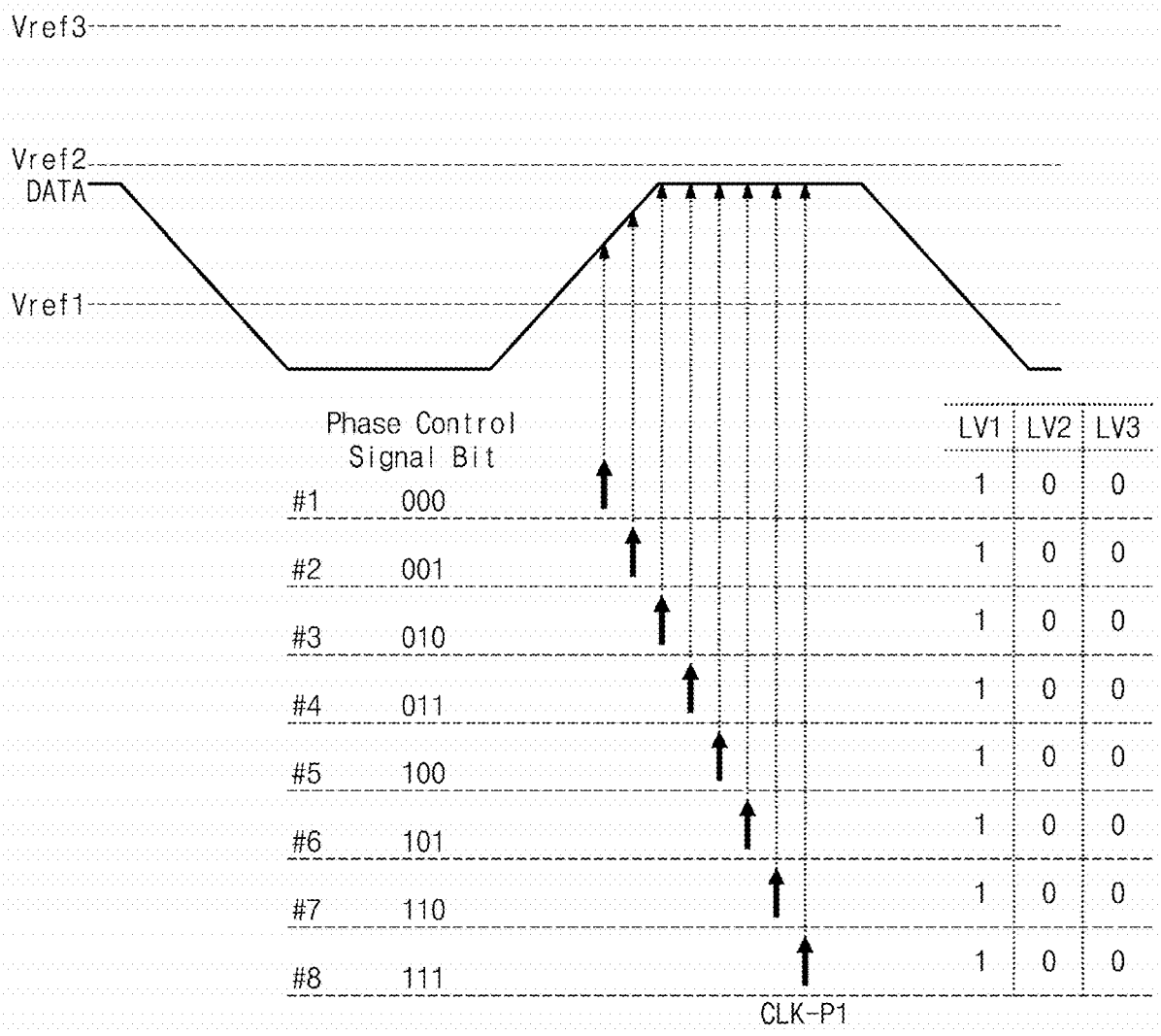
Figure 11:
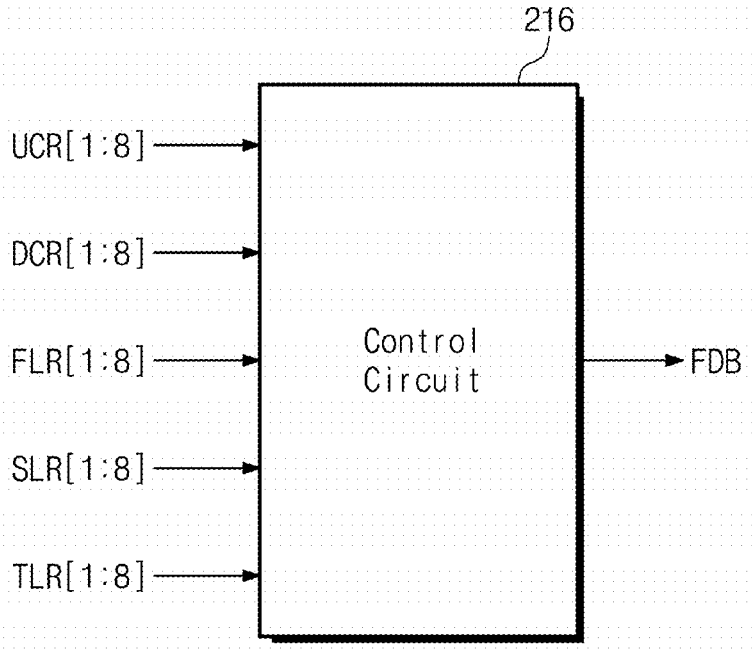
FIG. 11 is a block diagram showing an exemplary embodiment of a control circuit according to the invention.

FIGS. 8A, 8B, 9A, and 9B are views showing an exemplary embodiment of a method of determining an amount of the phase jitter using the control circuit 216 based on the data stored in the phase register circuit PRC. FIGS. 10A and 10B are views showing an exemplary embodiment of a method of determining an amount of the amplitude jitter using the control circuit 216 based on the data stored in the amplitude register circuit ARC. FIG. 11 is a block diagram showing an exemplary embodiment of the control circuit 216 according to the invention.

Figure 8A:
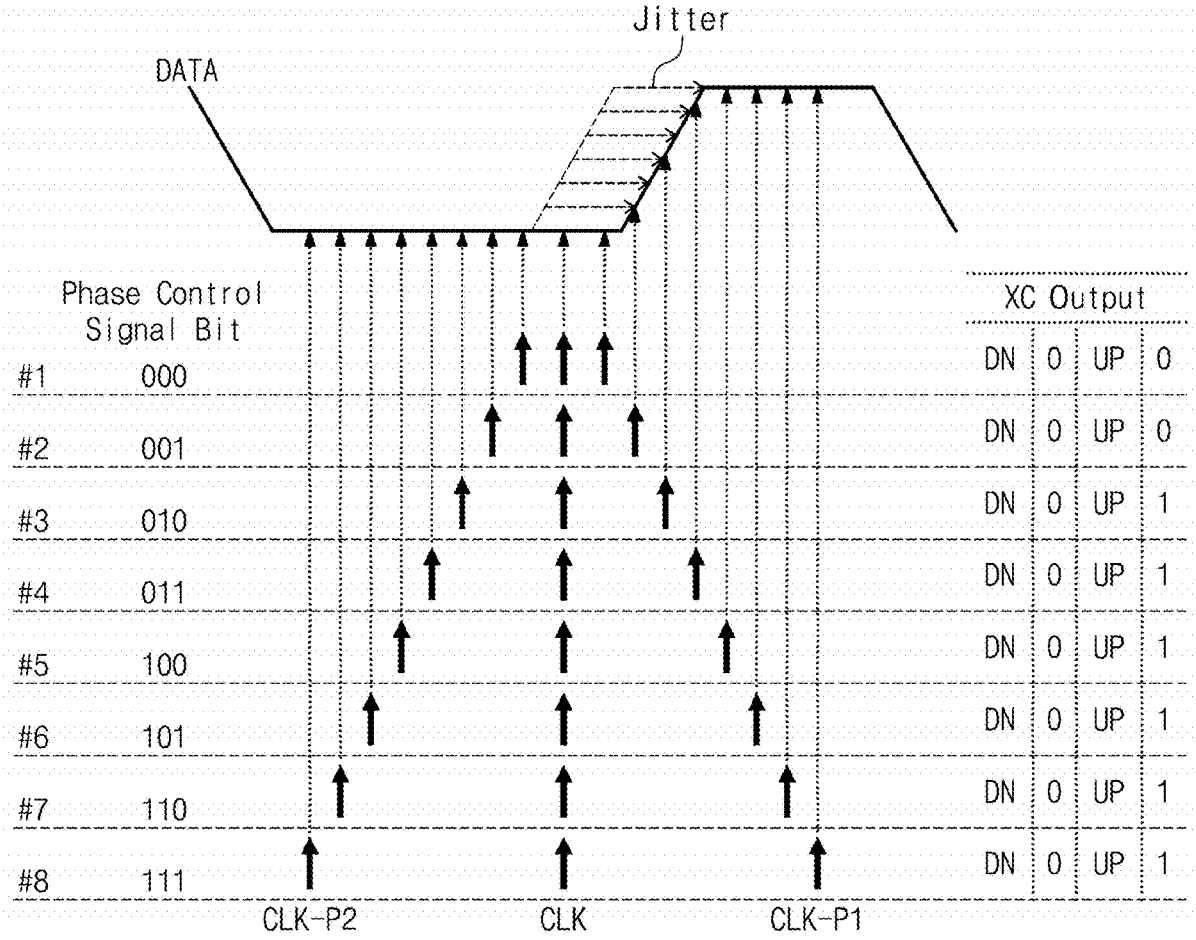
FIGS. 8A, 8B, 9A, and 9B are views showing an exemplary embodiment of a method of determining an amount of a phase jitter using a control circuit based on data stored in a phase register circuit.

FIG. 8A shows the occurrence of the phase jitter due to the advance of the phase of the data signal DATA.

Referring to FIGS. 6A, 8A to 9B, the phase control signal has three bits as an example. The value of the phase control signal gradually increases through eight steps from 000 to 111. For instance, first, second, third, fourth, fifth, sixth, seventh, and eighth steps correspond to the phase control signals of 000, 001, 010, 011, 100, 101, 110, and 111, respectively.

The phase of the first phase conversion clock signal CLK-P1 leads gradually from the first step to the eighth step, and the phase of the second phase conversion clock signal CLK-P2 lags behind gradually from the first step to the eighth step.

In the first and second steps, the normal clock signal CLK, the first phase conversion clock signal CLK-P1, and the second phase conversion clock signal CLK-P2 of the phase sampling circuit PSC sample the data signal DATA when the data signal DATA is in a low voltage state. Accordingly, all digital signals input to the exclusive OR circuit XC are zero (0), and thus all digital signals UP and DN output from the exclusive OR circuit XC are zero (0).

In third to eighth steps, the normal clock signal CLK and the second phase conversion clock signal CLK-P2 sample the data signal DATA when the data signal DATA is in the low voltage state, and the first phase conversion clock signal CLK-P1 samples the data signal DATA when the data signal DATA is in a high voltage state. Accordingly, the digital signals input to the first exclusive OR circuit XC1 from the first sampling D-flip flop D-S1 and from the second alignment D-flip flop D-A2 are 0 and 1 respectively, and thus the digital signal UP output from the first exclusive OR circuit XC1 is 1. On the contrary, all digital signals input to the second exclusive OR circuit XC2 are zero, and thus the digital signal DN output from the second exclusive OR circuit XC2 is zero.

Here, among the digital signals UP and DN output from the exclusive OR circuit XC, 0 indicates the low voltage state, and 1 indicates the high voltage state, but the indication rule should not be limited thereto or thereby.

Figure 8B:
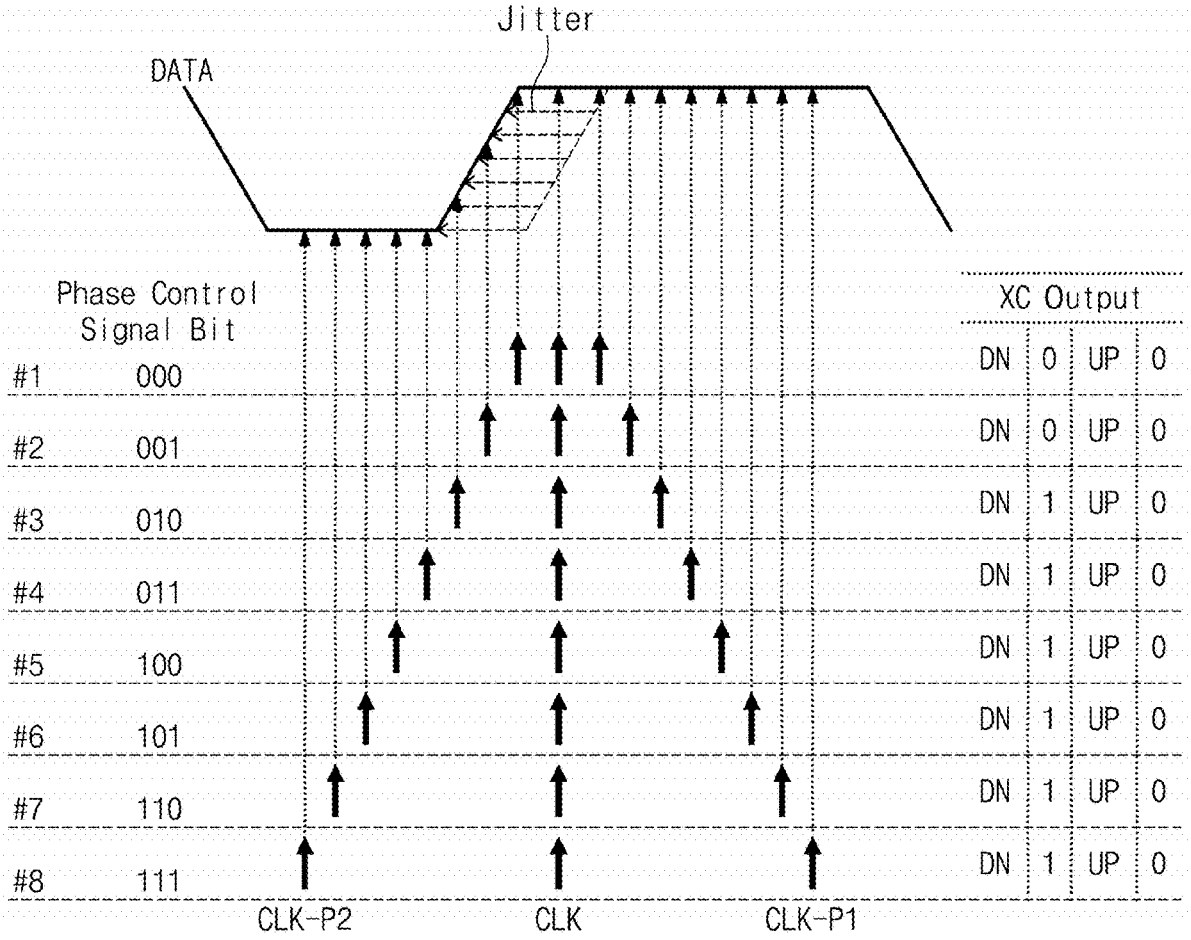

FIG. 8B shows the occurrence of the phase jitter due to the delay of the phase of the data signal DATA.

In the first and second steps, the normal clock signal CLK, the first phase conversion clock signal CLK-P1, and the second phase conversion clock signal CLK-P2 of the phase sampling circuit PSC sample the data signal DATA when the data signal DATA is in the high voltage state. Accordingly, all digital signals input to the exclusive OR circuit XC are 1, and thus all digital signals UP and DN output from the exclusive OR circuit XC are zero.

In third to eighth steps, the normal clock signal CLK and the first phase conversion clock signal CLK-P1 sample the data signal DATA when the data signal DATA is in the high voltage state, and the second phase conversion clock signal CLK-P2 samples the data signal DATA when the data signal DATA is in the low voltage state. Accordingly, all digital signals input to the first exclusive OR circuit XC1 are 1, and thus the digital signal UP output from the first exclusive OR circuit XC1 is zero. On the contrary, the digital signals input to the second exclusive OR circuit XC2 from the third alignment D-flip flop D-A3 and from the first alignment D-flip flop D-A1 are 0 and 1 respectively, and thus the digital signal DN output from the second exclusive OR circuit XC2 is 1.

As described above, the digital signals UP output from the first exclusive OR circuit XC1 are sequentially stored in the up-count registers UCR1 to UCR8 by the steps, and the digital signals DN output from the second exclusive OR circuit XC2 are sequentially stored in the down-count registers DCR1 to DCR8 by the steps.

The control circuit 216 reads out phase data UCR[1:8] stored in the up-count registers UCR1 to UCR8 and phase data DCR[1:8] stored in the down-count registers DCR1 to DCR8.

The control circuit 216 may monitor whether the phase of the data signal DATA leads or lags behind on the basis of the phase data stored in the up-count registers UCR1 to UCR8 and the down-count registers DCR1 to DCR8.

For instance, as shown in FIGS. 8A and 8B, since the signals UP and DN output from the first exclusive OR circuit XC1 and the second exclusive OR circuit XC2 are changed by whether the phase of the data signal DATA leads or lags behind the original data signal by the phase jitter, the control circuit 216 may monitor the displacement of the phase of the data signal DATA.

Figure 9A:
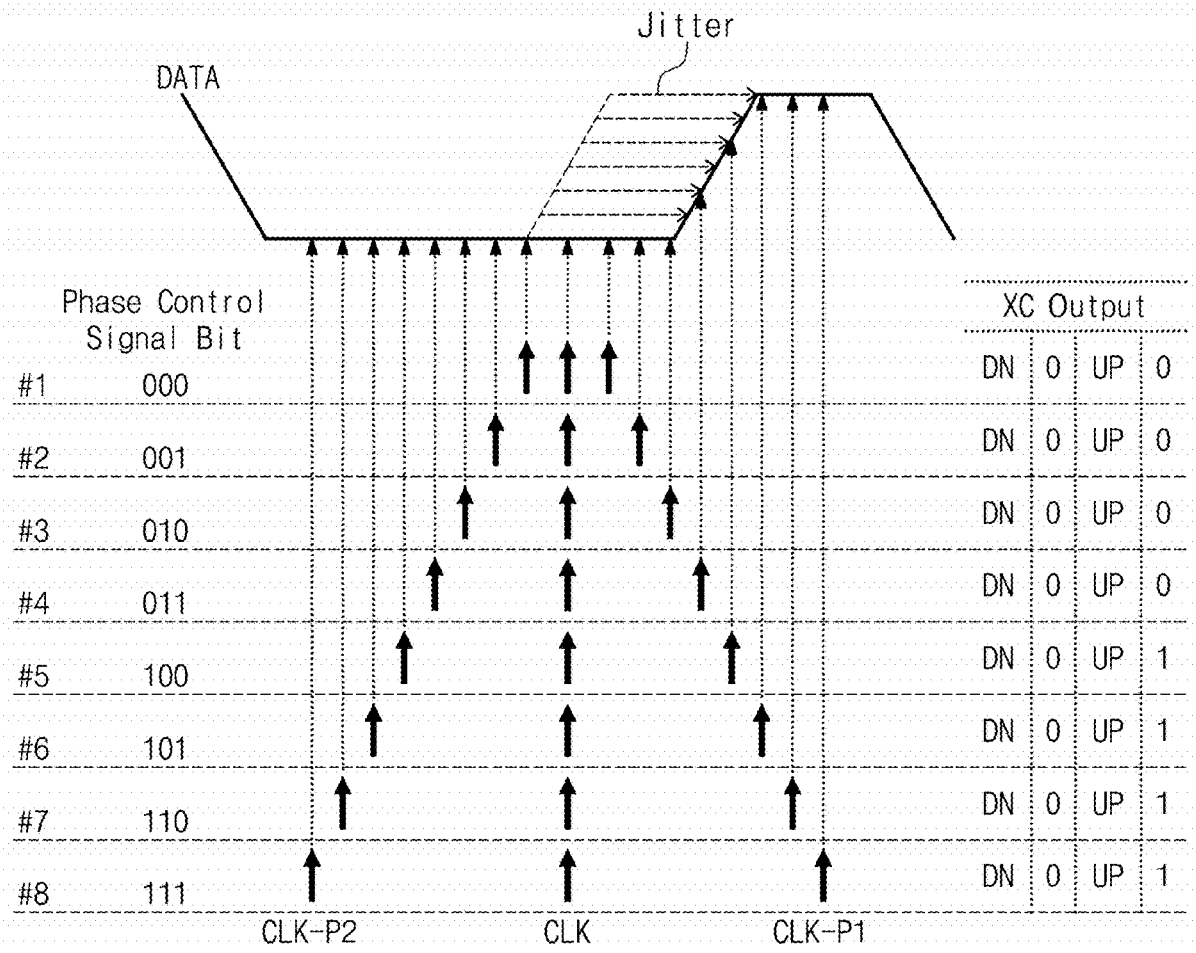
Figure 9B:
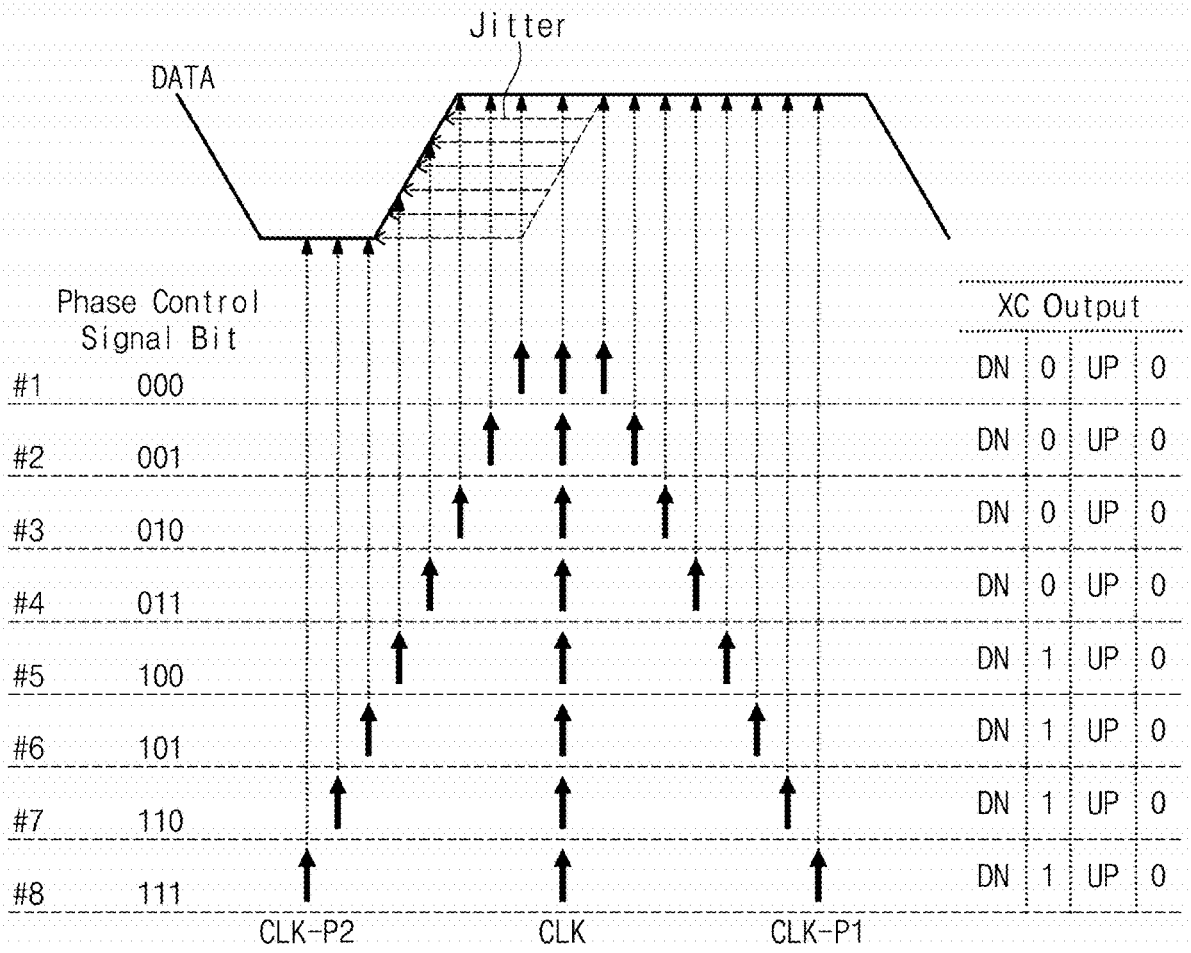

FIGS. 9A and 9B show the degree of phase change greater than that shown in FIGS. 8A and 8B.

Referring to FIG. 9A, in first to fourth steps, the normal clock signal CLK, the first phase conversion clock signal CLK-P1, and the second phase conversion clock signal CLK-P2 of the phase sampling circuit PSC sample the data signal DATA when the data signal DATA is in a low voltage state. Accordingly, all digital signals input to the exclusive OR circuit XC are zero 0, and thus all digital signals UP and DN output from the exclusive OR circuit XC are zero 0.

In fifth to eighth steps, the normal clock signal CLK and the second phase conversion clock signal CLK-P2 sample the data signal DATA when the data signal DATA is in the low voltage state, and the first phase conversion clock signal CLK-P1 samples the data signal DATA when the data signal DATA is in a high voltage state. Accordingly, the digital signals input to the first exclusive OR circuit XC1 from the first sampling D-flip flop D-S1 and from the second alignment D-flip flop D-A2 are 0 and 1 respectively, and thus the digital signal UP output from the first exclusive OR circuit XC1 is 1. On the contrary, all digital signals input to the second exclusive OR circuit XC2 are zero 0, and thus the digital signal DN output from the second exclusive OR circuit XC2 is zero 0.

Referring to FIG. 9B, in the first to fourth steps, the normal clock signal CLK, the first phase conversion clock signal CLK-P1, and the second phase conversion clock signal CLK-P2 of the phase sampling circuit PSC sample the data signal DATA when the data signal DATA is in the high voltage state. Accordingly, all digital signals input to the exclusive OR circuit XC are 1, and thus all digital signals UP and DN output from the exclusive OR circuit XC are zero 0.

In the fifth to eighth steps, the normal clock signal CLK and the first phase conversion clock signal CLK-P1 sample the data signal DATA when the data signal DATA is in the high voltage state, and the second phase conversion clock signal CLK-P2 samples the data signal DATA when the data signal DATA is in the low voltage state. Accordingly, all digital signals input to the first exclusive OR circuit XC1 are 1, and thus the digital signal UP output from the first exclusive OR circuit XC1 is zero 0. On the contrary, the digital signals input to the second exclusive OR circuit XC2 from the third alignment D-flip flop D-A3 and from the first alignment D-flip flop D-A1 are 0 and 1 respectively, and thus the digital signal DN output from the second exclusive OR circuit XC2 is 1.

The degree of phase change may be monitored by comparing tables shown in FIGS. 8A and 9A or comparing tables shown in FIGS. 8B and 9B. That is, the amount of the phase jitter may be monitored by the comparison. In FIGS. 8A and 8B, values of the digital signals UP and DN output from the first and second exclusive OR circuits XC1 and XC2 are the same as each other in the first and second steps, and in FIGS. 9A and 9B, the values of the digital signals UP and DN output from the first and second exclusive OR circuits XC1 and XC2 are the same as each other in the first to fourth steps. That is, as the amount of the phase jitter increases, the number of the steps in which the values output from the first and second exclusive OR circuits XC1 and XC2 are the same as each other increases. Accordingly, the control circuit 216 counts the number of the steps in which the values output from the first and second exclusive OR circuits XC1 and XC2 are the same as each other to determine the amount of the phase jitter.

FIGS. 10A and 10B show the occurrence of the amplitude jitter due to a decrease of the amplitude of the data signal DATA and the increase of the rising and falling times. FIGS. 10A and 10B show the occurrence of the amplitude jitter when the amplitude comparison circuit ACC receives the first phase conversion clock signal CLK-P1 as an example.

The comparators CP1, CP2, and CP3 of the amplitude comparison circuit ACC compare the data signals DATA respectively input thereto to the reference voltages Vref1, Vref2, and Vref3 respectively input thereto. The comparators CP1, CP2, and CP3 may output 1 respectively when the level of the data signals DATA is greater than that of the reference voltages Vref1, Vref2, and Vref3 respectively and may output 0 respectively when the level of the data signals DATA is smaller than that of the reference voltages Vref1, Vref2, and Vref3 respectively, but the kinds of the signal output from the comparators CP1, CP2, and CP3 should not be limited thereto. The kinds of the signal output from the comparators CP1, CP2, and CP3 may be changed in another exemplary embodiment.

Referring to FIG. 10A, in first to eighth steps, the first phase conversion clock signal CLK-P1 samples the data signal DATA which is greater than the first reference voltage Vref1. Accordingly, a digital signal LV1 output from the first comparator CP1 is 1 in the first to eighth steps.

In the second to eighth steps, the first phase conversion clock signal CLK-P1 samples the data signal DATA which is greater than the second reference voltage Vref2. Accordingly, a digital signal LV2 output from the second comparator CP2 is 1 in the second to eighth steps.

In first to eighth steps, the first phase conversion clock signal CLK-P1 samples the data signal DATA which is smaller than the third reference voltage Vref3. Accordingly, a digital signal LV3 output from the third comparator CP3 is zero (0) in the first to eighth steps.

Referring to FIG. 10B, in first to eighth steps, the first phase conversion clock signal CLK-P1 samples the data signal DATA which is greater than the first reference voltage Vref1. Accordingly, the digital signal LV1 output from the first comparator CP1 is 1 in the first to eighth steps.

In the first to eighth steps, the first phase conversion clock signal CLK-P1 samples the data signal DATA which is smaller than the second reference voltage Vref2. Accordingly, the digital signal LV2 output from the second comparator CP2 is zero (0) in the first to eighth steps.

In the first to eighth steps, the first phase conversion clock signal CLK-P1 samples the data signal DATA which is smaller than the third reference voltage Vref3. Accordingly, the digital signal LV3 output from the third comparator CP3 is zero (0) in the first to eighth steps.

The degree of amplitude change may be monitored by comparing the tables of FIGS. 10A and 10B. That is, the amount of the amplitude jitter may be monitored by the comparison.

According to the tables in FIGS. 10A and 10B, the amplitude is reduced as the number of the digital signals LV1, LV2, and LV3 output from the first, second, and third comparators CP1, CP2, and CP3 and having the value of zero (0) increases. Accordingly, the control circuit 216 counts the value of zero (0) of the digital signals LV1, LV2, and LV3 to monitor the degree of amplitude increase or decrease.

In addition, according to the tables in FIGS. 10A and 10B, as the number of the steps having the same set of values of the digital signals LV1, LV2, and LV3 increases, it may be determined that the rising time and the falling time become slow. Hereinafter, if values of the digital signals LV1, LV2, and LV3 are 1, 0, 0 respectively, the set of values is represented as "100." In FIG. 10A, the digital signals LV1, LV2, and LV3 having the set of values of "100" are shown one time, the digital signals LV1, LV2, and LV3 having the set of values of "110" are shown one time, and the digital signals LV1, LV2, and LV3 having the set of values of "110" are shown six times. In FIG. 10B, the digital signals LV1, LV2, and LV3 having the set of values of "100" are shown eight times. Therefore, the rising time and the falling time of the data signal DATA shown in FIG. 10B, in which the number of the digital signals LV1, LV2, and LV3 having the same set of values is relatively large, are slower than those of the data signal DATA shown in FIG. 10A. Here, if a short time is taken for the data signal DATA to rise, it is considered that the rising time is fast, and if a long time is taken for the data signal DATA to rise, it is considered that the rising time is slow. Accordingly, the control circuit 216 may monitor the rising time and the falling time by counting the number of the digital signals LV1, LV2, and LV3 having the same set of values.

Referring to FIG. 11, the control circuit 216 reads out the phase data UCR[1:8] stored in the up-count registers UCR1 to UCR8, the phase data DCR[1:8] stored in the down-count registers DCR1 to DCR8, the amplitude data FLR[1:8] stored in the first level registers FLR1 to FLR8, the amplitude data SLR[1:8] stored in the second level registers SLR1 to SLR8, and the amplitude data TLR[1:8] stored in the third level registers TLR1 to TLR8. The control circuit 216 generates a feedback signal FDB on the basis of the phase data UCR[1:8] and DCR[1:8] and the amplitude data FLR [1:8], SLR[1:8], and TLR[1:8].

Referring to FIGS. 5A and 5B, the feedback signal FDB may be input to at least one of the equalizer 211, the pre-emphasis circuit 302, and the output driver 303.

In the case that the feedback signal FDB is input to the equalizer 211, the equalizer 211 may allow an AC gain to become larger.

In the case that the feedback signal FDB is input to the pre-emphasis circuit 302, the pre-emphasis circuit 302 may emphasize the portion corresponding to the certain frequency band of the data signal DATA more than when the feedback signal FDB is not input to the pre-emphasis circuit 302.

In the case that the feedback signal FDB is input to the output driver 303, the output driver 303 may make a driving strength greater.

In an exemplary embodiment of the invention, the feedback signal FDB may control the data signal DATA such that a high frequency area of the transmitted data signal DATA is more emphasized than other frequency areas.

Figure 12:
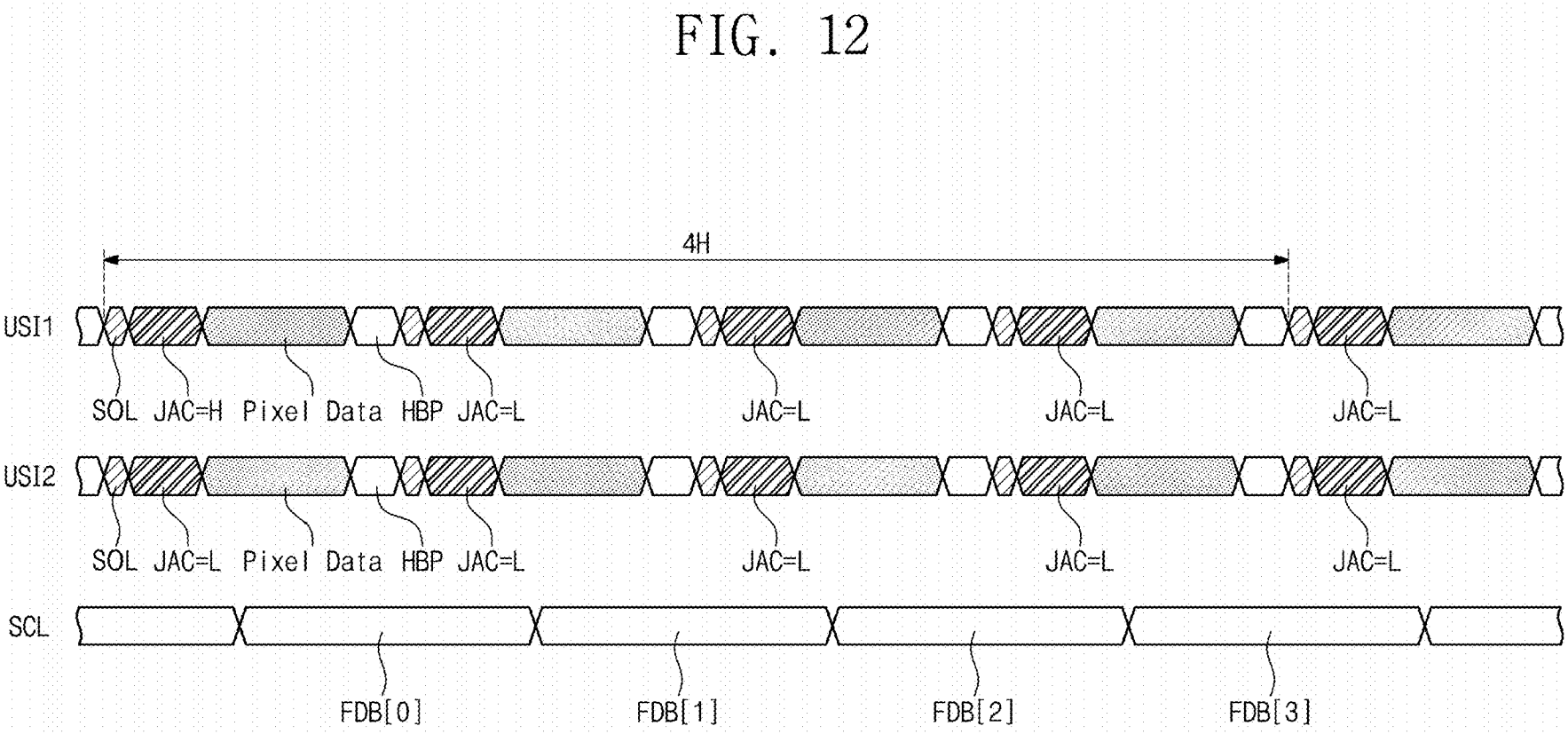
FIG. 12 is view showing an exemplary embodiment of a data package transmitted between a signal controller and a data driving circuit through an interface and a signal control line.

FIG. 12 is view showing an exemplary embodiment of a data package transmitted between the signal controller 300 and the data driving circuit 200 through interfaces USI1 and USI2 and the signal control line SCL.

Referring to FIG. 12, among the interfaces USI, each of two interfaces USI1 and USI2 adjacent to each other may include a start-of-line ("SOL"), a pixel data Pixel DATA, a horizontal blanking time ("HBP"), and a jitter analysis code ("JAC").

The SOL may be a signal indicating that the data corresponding to the pixels PX connected to one gate line GL are transmitted. The pixel data Pixel DATA may include substantial image information to generate the data voltages applied to the display panel DP. The HBP may indicate a waiting time to output the pixel data Pixel DATA in a next frame.

The jitter analysis code JAC may be a signal to instruct the starting of monitoring to the monitoring circuit 214 with respect to the jitter. When the jitter analysis code JAC has a high value H, the monitoring circuit 214 performs the monitoring on the jitter and transmits the feedback signal FDB according to the monitored result through the signal control line SCL. In a case that the jitter analysis code JAC has a low value L, the monitoring circuit 214 does not perform the monitoring on the jitter or does not transmit the feedback signal FDB according to the monitored result through the signal control line SCL.

In FIG. 12, one interface USI1 transmits the jitter analysis code JAC having the high value H, and thus the other interface USI2 transmits the jitter analysis code JAC having the low value L during four horizontal periods 4H as an example.

In a case that the driving chips 210 do not transmit the feedback signal FDB at the same time, the jitter may be monitored by adjusting the jitter analysis code JAC with respect to time as described above.

The monitoring circuit 214 and the control circuit 216 may transmit the feedback signal FDB including feedback data FDB[0], FDB[1], FDB[2], and FDB[3] through the signal control line SCL according to the monitored result of the jitter.

Although some exemplary embodiments of the invention have been described, it is understood that the invention should not be limited to these exemplary embodiments, but various changes and modifications can be made by one ordinary skilled in the art within the spirit and scope of the invention as hereinafter claimed. Therefore, the disclosed subject matter should not be limited to any single exemplary embodiment described herein, and the scope of the inventive concept shall be determined according to the attached claims.

What is claimed is:

1. A display device comprising:

a plurality of pixels;

a data driving circuit which comprises a plurality of driving chips, each of which provides a data signal to corresponding pixels among the plurality of pixels; and a signal controller connected to the plurality of driving chips by an interface and which provides the data signal to the data driving circuit, wherein at least one of the plurality of driving chips comprises a monitoring circuit comprising a phase monitoring circuit which receives the data signal from the signal controller and a clock generation circuit which receives a normal clock signal and generates a first phase conversion clock signal and a second phase conversion clock signal which have phase differences from the normal clock signal, the phase monitoring circuit comprising:

a phase sampling circuit comprising a first sampling D-flip flop which receives the data signal and the normal clock signal, a second sampling D-flip flop which receives the data signal and the first phase conversion clock signal, and a third sampling D-flip flop which receives the data signal and the second phase conversion clock signal;

a phase alignment circuit comprising a first alignment D-flip flop which receives an output of the first sampling D-flip flop and the normal clock signal, a second alignment D-flip flop which receives an output of the second sampling D-flip flop and the normal clock signal, and a third alignment D-flip flop which receives an output of the third sampling D-flip flop and the normal clock signal;

an exclusive OR circuit which receives an output of the phase sampling circuit or an output of the phase alignment circuit; and a phase register circuit which stores data output from the exclusive OR circuit.

2. The display device of claim 1, wherein the first phase conversion clock signal has a phase leading a phase of the normal clock signal, and the second phase conversion clock signal has a phase lagging behind the phase of the normal clock signal.

3. The display device of claim 2, wherein a phase difference between the first phase conversion clock signal and the normal clock signal is equal to a phase difference between the second phase conversion clock signal and the normal clock signal.

4. The display device of claim 1, wherein the first phase conversion clock signal has a phase leading the normal clock signal by about X degrees, and the second phase conversion clock signal has a phase leading the normal clock signal by about 360-X degrees.

5. The display device of claim 1, wherein the exclusive OR circuit comprises:

a first exclusive OR circuit which receives the output of the first sampling D-flip flop and an output of the second alignment D-flip flop; and a second exclusive OR circuit which receives an output of the first alignment D-flip flop and an output of the third alignment D-flip flop.

6. The display device of claim 5, wherein the clock generation circuit comprises a frequency divider which generates a low frequency clock signal having a frequency lower than the normal clock signal, and the phase monitoring circuit further comprises a phase frequency conversion circuit which comprises:

a first phase frequency D-flip flop which receives an output of the first exclusive OR circuit and the low frequency clock signal; and a second phase frequency D-flip flop which receives an output of the second exclusive OR circuit and the low frequency clock signal.

7. The display device of claim 6, wherein the phase register circuit comprises:

n up-count registers which sequentially stores outputs of the first phase frequency D-flip flop; and n down-count registers which sequentially stores outputs of the second phase frequency D-flip flop, wherein n is a natural number equal to or greater than 2.

8. The display device of claim 7, wherein a phase control signal is input to the clock generation circuit to control a phase of the first phase conversion clock signal and a phase of the second phase conversion clock signal, the phase control signal is an m-bit digital signal, m is a natural number equal to or greater than 1, and a value of the n is equal to a value of $2^m$.

9. The display device of claim 7, further comprising a control circuit which reads out phase data stored in the n up-count registers and the n down-count registers and outputs a feedback signal based on the readout phase data.

10. The display device of claim 9, wherein the signal controller further comprises:

a pre-emphasis circuit which emphasizes a portion corresponding to a predetermined frequency band of the data signal; and an output driver which transmits the data signal received from the pre-emphasis circuit to the data driving circuit through the interface, and at least one of the plurality of driving chips further comprises:

an equalizer which uniformly converts frequency characteristics of the data signal received from the signal controller; and a clock recovery circuit which generates the normal clock signal using the data signal received from the equalizer.

11. The display device of claim 10, wherein the feedback signal is input to at least one of the pre-emphasis circuit, the output driver, and the equalizer.

12. The display device of claim 10, wherein the pre-emphasis circuit receives the feedback signal and more emphasizes the portion corresponding to the predetermined frequency band of the data signal, the output driver receives the feedback signal and makes a drive strength greater, and the equalizer receives the feedback signal and makes an AC gain greater.

13. The display device of claim 9, wherein the at least one of the plurality of driving chips further comprises an amplitude monitoring circuit comprising an amplitude comparison circuit, and the amplitude comparison circuit comprises:

a first comparator which receives a first reference voltage and the data signal;

a second comparator which receives a second reference voltage having a level greater than the first reference voltage and the data signal; and a third comparator which receives a third reference voltage having a level greater than the second reference voltage and the data signal.

14. The display device of claim 13, wherein each of the first comparator, the second comparator, and the third comparator comprises an operational (OP) amplifier, and the first phase conversion clock signal or the second phase conversion clock signal is input to a power terminal of the operational amplifier.

15. The display device of claim 14, wherein the amplitude monitoring circuit further comprises an amplitude frequency conversion circuit which receives an output of the amplitude comparison circuit, and the amplitude frequency conversion circuit comprises:

a first amplitude frequency D-flip flop which receives an output of the first comparator and the low frequency clock signal;

a second amplitude frequency D-flip flop which receives an output of the second comparator and the low frequency clock signal; and a third amplitude frequency D-flip flop which receives an output of the third comparator and the low frequency clock signal.

16. The display device of claim 15, wherein the amplitude monitoring circuit further comprises an amplitude register circuit which stores data output from the amplitude frequency conversion circuit, and the amplitude register circuit comprises:

k first level registers which sequentially stores outputs of the first amplitude frequency D-flip flop;

k second level registers which sequentially stores outputs of the second amplitude frequency D-flip flop; and k third level registers which sequentially stores outputs of the third amplitude frequency D-flip flop, wherein k is a natural number equal to or greater than 2.

17. The display device of claim 16, wherein the control circuit reads out amplitude data stored in the k first level registers, the k second level registers, and the k third level registers and outputs the feedback signal based on the readout amplitude data.

18. The display device of claim 17, wherein a value of the k is equal to a value of the n.

* * * * *